US006875562B2

(12) United States Patent
Yamashita et al.

(10) Patent No.: US 6,875,562 B2
(45) Date of Patent: Apr. 5, 2005

(54) SILVER HALIDE PHOTOGRAPHIC EMULSION AND SILVER HALIDE PHOTOGRAPHIC MATERIAL CONTAINING SAID SILVER HALIDE PHOTOGRAPHIC EMULSION

(75) Inventors: Katsuhiro Yamashita, Kanagawa (JP); Katsumi Kobayashi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/352,106

(22) Filed: Jan. 28, 2003

(65) Prior Publication Data

US 2003/0215760 A1 Nov. 20, 2003

Related U.S. Application Data

(62) Division of application No. 09/987,373, filed on Nov. 14, 2001, now Pat. No. 6,537,742, which is a division of application No. 09/739,884, filed on Dec. 20, 2000, now Pat. No. 6,387,610, which is a continuation of application No. 09/469,226, filed on Dec. 22, 1999, now Pat. No. 6,180,332, which is a continuation of application No. 08/956,027, filed on Oct. 22, 1997, now Pat. No. 6,117,629.

(30) Foreign Application Priority Data

Oct. 24, 1996 (JP) ..... 8-282595
Dec. 26, 1996 (JP) ..... 8-348524

(51) Int. Cl.[7] ..... G03C 1/46; G03C 1/005

(52) U.S. Cl. ..... 430/505; 430/502; 430/543; 430/567; 430/569; 430/572; 430/573; 430/574; 430/577; 430/580

(58) Field of Search ..... 430/572, 569, 430/567, 573, 574, 577, 580, 505, 502, 543

(56) References Cited

U.S. PATENT DOCUMENTS

| | | | | |
|---|---|---|---|---|
| 3,622,316 | A | | 11/1971 | Bird et al |
| 3,973,969 | A | | 8/1976 | Shiba et al. |
| 5,302,499 | A | | 4/1994 | Merrill et al. |
| 5,541,047 | A | * | 7/1996 | Kashiwagi et al. ..... 430/522 |
| 5,561,039 | A | | 10/1996 | Ochiai |
| 5,573,894 | A | | 11/1996 | Kodama et al. |
| 5,604,088 | A | | 2/1997 | Asami et al. |
| 5,637,446 | A | | 6/1997 | Yamashita |
| 6,117,629 | A | | 9/2000 | Yamashita et al. |
| 6,143,486 | A | | 11/2000 | Parton et al. |
| 6,165,703 | A | | 12/2000 | Parton et al. |
| 6,180,332 | B1 | | 1/2001 | Yamashita et al. |

FOREIGN PATENT DOCUMENTS

JP 63-108335 * 5/1988

OTHER PUBLICATIONS

Thomas L. Penner et al., "Spectral Shifts and Physical Layering of Sensitizing Dye Combinations in Silver Halide Emulsions," *Photographic Science and Engineering*, vol. 20, No. 3, (1976), pp. 97–106.

* cited by examiner

*Primary Examiner*—Thorl Chea
(74) *Attorney, Agent, or Firm*—Sughrue Mion, PLLC

(57) ABSTRACT

A silver halide photographic emulsion which contains silver halide grains having light absorption strength of 100 or more.

7 Claims, No Drawings

SILVER HALIDE PHOTOGRAPHIC EMULSION AND SILVER HALIDE PHOTOGRAPHIC MATERIAL CONTAINING SAID SILVER HALIDE PHOTOGRAPHIC EMULSION

This is a divisional of application Ser. No. 09/987,373 filed Nov. 14, 2001, now U.S. Pat. No. 6,537,742 which is a divisional of application Ser. No. 09/739,884, filed Dec. 20, 2000, now issued as U.S. Pat. No. 6,387,610, which is a continuation of application Ser. No. 09/469,226, filed Dec. 22, 1999, now issued as U.S. Pat. No. 6,180,332 B1, which is a continuation of application Ser. No. 08/956,027, filed Oct. 22, 1997, now issued as U.S. Pat. No. 6,117,629; the disclosures of which are incorporated herein by reference.

FIELD OF THE INVENTION

The present invention relates to a spectrally sensitized silver halide photographic emulsion and a method for producing the same and, further, relates to a silver halide photographic material containing said emulsion.

BACKGROUND OF THE INVENTION

The sensitivity of a silver halide photographic material is determined by the light absorption factor of a grain, latent image forming efficiency including spectral sensitization efficiency and a minimum size of a latent image.

Of these factors, as to techniques of improving the light absorption factor of a grain, some which are known heretofore are shown below.

Techniques of high aspect ratio tabular grain emulsions disclosed in U.S. Pat. No. 5,494,789, etc., are techniques capable of increasing a dye adsorption amount per one grain because a tabular grain has a larger grain surface area, as a result, the light absorption factor can be improved. However, there are limitations in the increase of the surface area of a grain by heightening an aspect ratio and the like, therefore, a larger sized grain is necessary to improve the light absorption factor of one grain.

In addition to the above, as methods of increasing the grain surface area per one grain, methods of making a pore at a part of a grain are disclosed in JP-A-58-106532 (the term "JP-A" as used herein means an "unexamined published Japanese patent application") and JP-A-60-221320, and a ruffled grain is disclosed in U.S. Pat. No. 4,643,966. However, the forms of grains according to these methods are unstable and accompanied by extreme difficulties in practical use.

Further, U.S. Pat. No. 5,302,499 discloses that a light absorption factor can be improved by constituting the layer structure having spectral sensitization characteristics and optimal grain thicknesses. But the improvement of a light absorption factor by the optimization of the grain thicknesses is at most 10% or so.

Accordingly, for markedly improving a light absorption factor of one grain while maintaining a grain size small with a stable grain form, it is necessary to improve the light absorption factor per unit surface area of a grain. For that sake, it is necessary to heighten the adsorption density of a sensitizing dye, but a generally used spectral sensitizing dye is adsorbed onto a monolayer with almost the closest charging and is adsorbed no more.

Methods which have been proposed for a sensitizing dye to be multilayer adsorbed onto a grain surface are shown below.

In P. B. Gilman, Jr., et al., *Photographic Science and Engineering*, Vol. 20, No. 3, p. 97 (1976), a cationic dye is adsorbed onto the first layer and an anionic dye is adsorbed onto the second layer using electrostatic power.

Further, G. B. Bird, et al., in U.S. Pat. No. 3,622,316, a plurality of dyes are multilayer adsorbed onto silver halide and sensitized by Forster type excitation energy transfer.

However, even these above-described methods could not sufficiently improve the light absorption factor per unit surface area of a silver halide grain, therefore, a further technical development has been required.

SUMMARY OF THE INVENTION

An object of the present invention is to provide a method for producing a silver halide emulsion having a high light absorption factor per unit area of a grain surface and a photographic material of high sensitivity using said emulsion.

The above object of the present invention has been achieved by the following (1), (2), (3), (4), (5), (6), (7) and (8).

(1) A silver halide photographic emulsion which contains silver halide grains having light absorption strength of 100 or more, wherein said silver halide grains are preferably spectrally sensitized.

(2) A silver halide photographic material which has at least one silver halide photographic emulsion layer containing the silver halide photographic emulsion described in (1) above.

(3) A silver halide photographic emulsion which contains silver halide grains having a spectral absorption maximum wavelength of 500 nm or less and light absorption strength of 60 or more and less than 100, wherein said silver halide grains are preferably spectrally sensitized.

(4) A silver halide photographic material which has at least one silver halide photographic emulsion layer containing the silver halide photographic emulsion described in (3) above.

(5) A silver halide photographic emulsion which contains at least one dye represented by the following formula (1) or (2) in an amount equivalent to the amount of 80% or more of the saturated coated amount and the total addition amount of sensitizing dyes is equivalent to the amount of 160% or more of the saturated coated amount:

(1)

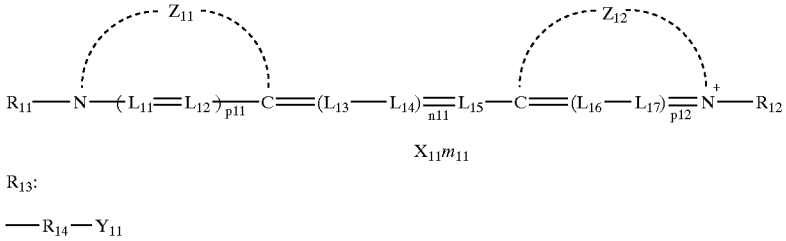

$R_{13}$:

$—R_{14}—Y_{11}$ wherein $R_{11}$ and $R_{12}$ each represents an alkyl group, at least one of $R_{11}$ and $R_{12}$ is an alkyl group represented by $R_{13}$, where $R_{14}$ represents a single bond or a divalent linking group and $Y_{11}$ represents an aryl group or a heterocyclic aromatic group, and neither $R_{11}$ nor $R_{12}$ has an anionic substituent; $Z_{11}$ and $Z_{12}$, which may be the same or different, each represents a 5- or 6-membered nitrogen-containing heterocyclic nucleus-forming atomic group; $L_{11}$, $L_{12}$, $L_{13}$, $L_{14}$, $L_{15}$, $L_{16}$ and $L_{17}$ each represents a methine group; $p_{11}$ and $p_{12}$ each represents 0 or 1, $n_{11}$ represents 0, 1, 2 or 3; $X_{11}$ represents a counter ion for balancing a charge; and $m_{11}$ represents a number of from 0 to 8 necessary for neutralizing a charge in the molecule;

(2)

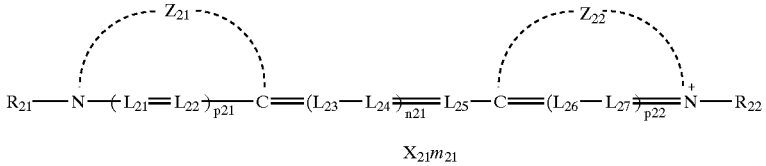

$R_{23}$:

$—R_{24}—Y_{21}$ wherein $R_{21}$ and $R_{22}$ each represents an alkyl group, at least one of $R_{21}$ and $R_{22}$ is an alkyl group represented by $R_{23}$, where $R_{24}$ represents a single bond or a divalent linking group and $Y_{21}$ represents an aryl group or a heterocyclic aromatic group, and both $R_{21}$ and $R_{22}$ have an anionic substituent; $Z_{21}$ and $Z_{22}$, which may be the same or different, each represents a 5- or 6-membered nitrogen-containing heterocyclic nucleus-forming atomic group; $L_{21}$, $L_{22}$, $L_{23}$, $L_{24}$, $L_{25}$, $L_{26}$ and $L_{27}$ each represents a methine group; $p_{21}$ and $p_{22}$ each represents 0 or 1, $n_{21}$ represents 0, 1, 2 or 3; $X_{21}$ represents a counter ion for balancing a charge; and $m_{21}$ represents a number of from 0 to 8 necessary for neutralizing a charge in the molecule.

(6) A silver halide photographic material which has at least one silver halide photographic emulsion layer containing the silver halide photographic emulsion described in (5) above.

(7) A silver halide photographic emulsion which contains at least one dye represented by formula (1) and at least one dye represented by formula (2) described in (5) above.

(8) A silver halide photographic material which has at least one silver halide photographic emulsion layer containing the silver halide photographic emulsion described in (7) above.

A sensitizing dye can be multilayer adsorbed onto the surface of a silver halide grain according to the above method, and light absorption strength by a sensitizing dye per unit area of a silver halide grain surface can be made 100 or more, only when a grain has a spectral absorption maximum wavelength of 500 nm or less, light absorption strength of 60 or more. "Light absorption strength" in the above (1) and (3) means the light absorption strength per unit surface area by a sensitizing dye except for absorption by a silver halide grain. "The light absorption strength per unit surface area by a sensitizing dye" used herein is defined as the value obtained by integrating optical density Log $(I_0/(I_0-I))$ to wave number ($cm^{-1}$), taking the light amount incident on the unit surface area of a grain as $I_0$ and the light amount absorbed by the sensitizing dye at said surface as I, and the integrated range is from 5,000 $cm^{-1}$ to 35,000 $cm^{-1}$.

When a silver halide photographic emulsion contains silver halide grains having light absorption strength of 100 or more (or light absorption strength of 60 or more when the grains have spectral absorption maximum wavelength of 500 nm or less), it is preferred that ½ or more of the entire amount of silver halide grains contained in the emulsion be silver halide grains having light absorption strength of 100 or more (or light absorption strength of 60 or more when the grains have spectral absorption maximum wavelength of 500 nm or less). Further, light absorption strength is preferably from 100 to 100,000, provided that light absorption strength of a grain having a spectral absorption maximum wavelength of 500 nm or less is preferably from 80 to 100,000, more preferably from 100 to 100,000. With respect to a grain having a spectral absorption maximum wavelength of 500 nm or less, a spectral absorption maximum wavelength is preferably 350 nm or more.

According to the kinds of photographic materials, as it is required to have strong absorption in a narrower wave number range, it is more preferred to select the kinds of dyes so as to 90% or more of light absorption strength is concentrated within the integrated range of from x $cm^{-1}$ to x+5,000 $cm^{-1}$ (where x is the value to make the above range of light absorption strength maximum, 5,000 $cm^{-1}$<x<30,000 $cm^{-1}$).

The saturated coated amount in the present invention is the amount of a sensitizing dye which completely coats the grain surface of an emulsion taking the molecular occupancy area of the sensitizing dye as 80 $Å^2$.

In the method in (6) above, the total addition amount of sensitizing dyes is preferably equivalent to the amount of 160% or more of the saturated coated amount, more preferably the sum total of the addition amount of the dyes represented by formulae (1) and (2) is equivalent to the amount of 160% or more of the saturated coated amount, and particularly preferably the addition amount of each of the dyes represented by formulae (1) and (2) is equivalent to the amount of 80% or more of the saturated coated amount.

DETAILED DESCRIPTION OF THE INVENTION

The present invention will be described in detail below.

In formula (1), preferred examples of nitrogen-containing heterocyclic nuclei represented by $Z_{11}$ and $Z_{12}$ include thiazole, benzothiazole, naphthothiazole, dihydronaphthothiazole, selenazole, benzoselenazole, naphthoselenazole, dihydronaphthoselenazole, oxazole, benzoxazole, naphthoxazole, benzimidazole, naphthoimidazole, pyridine, quinoline, imidazo[4,5-b] quinoxaline and 3,3-dialkylindolenine. More preferred nitrogen-containing heterocyclic nuclei are benzothiazole, naphthothiazole, dihydronaphthothiazole, benzoselenazole, naphthoselenazole, dihydronaphthoselenazole, benzoxazole, naphthoxazole; benzimidazole or naphthoimidazole.

The above nitrogen-containing heterocyclic nuclei represented by $Z_{11}$ and $Z_{12}$ may have one or more substituents. Substituents are not particularly limited, and preferred examples of substituents, when the nitrogen-containing heterocyclic nuclei represented by $Z_{11}$ and $Z_{12}$ are other than benzimidazole and naphthoimidazole, include a lower alkyl group (which may be branched or may further have a substituent (e.g., a hydroxyl group, a halogen atom, an aryl group, an aryloxy group, an arylthio group, an alkoxyl group, an alkylthio group, an alkoxycarbonyl group, etc.), more preferably an alkyl group having 8 or less total carbon atoms, e.g., methyl, ethyl, butyl, chloroethyl, 2,2,3,3-tetrafluoropropyl, hydroxyl, benzyl, methoxyethyl, ethylthioethyl, ethoxycarbonylethyl), a lower alkoxyl group (which may further have a substituent, e.g., those described above as substituents for the alkyl group, more preferably an alkoxyl group having 8 or less total carbon atoms, e.g., methoxy, ethoxy, pentyloxy, ethoxymethoxy, methylthioethoxy, phenoxyethoxy, hydroxyethoxy, chloropropoxy), a hydroxyl group, a halogen atom, an aryl group (e.g., phenyl, tolyl, anisyl, chlorophenyl), a heterocyclic group (e.g., thienyl, furyl, pyridyl), an aryloxy group (e.g., tolyloxy, anisyloxy, phenoxy, chlorophenoxy), an arylthio group (e.g., tolylthio, chlorophenylthio, phenylthio), a lower alkylthio group (which may further have a substituent, e.g., those described above as substituents for the lower alkyl group, more preferably an alkylthio group having 8 or less total carbon atoms, e.g., methylthio, ethylthio, hydroxyethylthio, chloroethylthio, benzylthio), an acylamino group (more preferably an acylamino group having 8 or less total carbon atoms, e.g., acetylamino, benzoylamino, methanesulfonylamino, benzenesulfonylamino), a carboxyl group, a lower alkoxycarbonyl group (more preferably an alkoxycarbonyl group having 6 or less total carbon atoms, e.g., ethoxycarbonyl, butoxycarbonyl), a perfluoroalkyl group (more preferably a perfluoroalkyl group having 5 or less total carbon atoms, e.g., trifluoromethyl, difluoromethyl), and an acyl group (more preferably an acyl group having 8 or less total carbon atoms, e.g., acetyl, propionyl, benzoyl, benzenesulfonyl). When the nitrogen-containing heterocyclic nuclei represented by $Z_{11}$ and $Z_{12}$ are benzimidazole or naphthoimidazole, preferred examples of substituents include a halogen atom, a cyano group, a carboxyl group, a lower alkoxycarbonyl group (more preferably an alkoxycarbonyl group having 6 or less total carbon atoms, e.g., ethoxycarbonyl, butoxycarbonyl), a perfluoroalkyl group (more preferably a perfluoroalkyl group having 5 or less total carbon atoms, e.g., trifluoromethyl, difluoromethyl), and an acyl group (more preferably an acyl group having 8 or less total carbon atoms, e.g., acetyl, propionyl, benzoyl, benzenesulfonyl).

Specific examples of nitrogen-containing heterocyclic nuclei represented by $Z_{11}$ and $Z_{12}$ include, e.g., benzothiazole, 5-methylbenzothiazole, 6-methylbenzothiazole, 5-ethylbenzothiazole, 5,6-dimethylbenzothiazole, 5-methoxybenzothiazole, 6-methoxybenzothiazole, 5-butoxybenzothiazole, 5,6-dimethoxybenzothiazole, 5-methoxy-6-methylbenzothiazole, 5-chlorobenzothiazole, 5-chloro-6-methylbenzothiazole, 5-phenylbenzothiazole, 5-acetylaminobenzothiazole, 6-propionylaminobenzothiazole, 5-hydroxybenzothiazole, 5-hydroxy-6-methylbenzothiazole, 5-ethoxycarbonylbenzothiazole, 5-carboxybenzothiazole, naphtho[1,2-d]thiazole, naphtho[2,1-d]thiazole, 5-methylnaphtho[1,2-d]thiazole, 8-methoxynaphtho[1,2-d] thiazole, 8,9-dihydronaphthothiazole, 3,3-diethylindolenine, 3,3-dipropylindolenine, 3,3-dimethylindolenine, 3,3,5-trimethylindolenine, benzoselenazole, 5-methylbenzoselenazole, 6-methylbenzoselenazole, 5-methoxybenzoselenazole, 6-methoxybenzoselenazole, 5-chlorobenzoselenazole, 5,6-dimethylbenzoselenazole, 5-hydroxybenzoselenazole, 5-hydroxy-6-methylbenzoselenazole, 5,6-dimethoxybenzoselenazole, 5-ethoxycarbonylbenzoselenazole, naphtho[1,2-d] selenazole, naphtho[2,1-d]selenazole, benzoxazole, 5-hydroxybenzoxazole, 5-methoxybenzoxazole, 5-phenylbenzoxazole, 5-phenethylbenzoxazole, 5-phenoxybenzoxazole, 5-chlorobenzoxazole, 5-chloro-6-methylbenzoxazole, 5-phenylthiobenzoxazole, 6-ethoxy-5-hydroxybenzoxazole, 6-methoxybenzoxazole, naphtho[1,2-d]oxazole, naphtho[2,1-d]oxazole, 1-ethyl-5-cyanobenzimidazole, 1-ethyl-5-chlorobenzimidazole, 1-ethyl-5,6-dichlorobenzimidazole, 1-ethyl-6-chloro-5-cyanobenzimidazole, 1-ethyl-6-chloro-5-trifluoromethylbenzimidazole, 1-ethyl-6-fluoro-5-cyanobenzimidazole, 1-propyl-5-butoxycarbonylbenzimidazole, 1-benzyl-5-methylsulfonylbenzimidazole, 1-allyl-5-chloro-6-acetylbenzimidazole, 1-ethyl-naphtho[1,2-d]imidazole, 1-ethylnaphtho[2,1-d]imidazole, 1-ethyl-6-chloronaphtho [2,1-d]imidazole, 2-quinoline, 4-quinoline, 8-fluoro-4-quinoline, 6-methyl-2-quinoline, 6-hydroxy-2-quinoline, 6-methoxy-2-quinoline, etc.

$R_{11}$ and $R_{12}$ in formula (1) each represents a substituted or unsubstituted alkyl group which may contain an oxygen atom, a nitrogen atom or a sulfur atom in the main chain thereof, and further may contain a double bond or a triple bond. Preferred substituents include the substituents described for $Z_{11}$ and $Z_{12}$ above, but an anionic substituent is not included. The anionic substituent in the present invention means a substituent having negative electric charge, i.e., an atomic group liable to be dissociated under a neutral or slightly alkaline condition, in particular, a substituent having a hydrogen atom. For example, a sulfo group (—$SO_3$—), a sulfuric acid group (—$OSO_3$—), a carboxyl group (—$CO_2$—), a phosphoric acid group (—$PO_3$—), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl), or an alkylsulfonylsulfamoylalkyl group (e.g., methanesulfonylsulfamoylmethyl) can be cited.

Specific examples of $R_{11}$ and $R_{12}$ include, e.g., methyl, ethyl, propyl, isopropyl, butyl, isobutyl, hexyl, octyl, dodecyl, octadecyl, benzyl, 2-phenylethyl, allyl, 2-hydroxyethyl, 3-hydroxypropyl, 2-methoxyethyl, 2-phenoxyethyl, 2-(1-naphthoxy)ethyl, ethoxycarbonylmethyl, 2-benzyloxycarbonylethyl, 2-phenoxycarbonylpropyl, 2-acetylethyl, 2-(pyrrolidin-2-one-1-yl)ethyl, tetrahydrofurfuryl, etc.

Both $R_{11}$ and $R_{12}$ are more preferably represented by $R_{13}$.

The divalent linking group represented by $R_{14}$ in $R_{13}$ is more preferably an alkylene group having 10 or less total carbon atoms, which may contain an oxygen atom, a nitrogen atom or a sulfur atom in the main chain thereof, or may contain a double bond or a triple bond. The alkylene group may be branched, or may further have a substituent but an anionic substituent is not included (those described above as examples of anionic substituents can be cited, e.g., a sulfo group or a carboxyl group). Substituents cited above as preferred substituents for $Z_{11}$ and $Z_{12}$ can be cited as examples of preferred substituents for the alkylene group, e.g., a halogen atom, a hydroxyl group, an alkoxyl group having 6 or less carbon atoms, an aryl group having 8 or less carbon atoms which may be substituted (e.g., phenyl, tolyl), a heterocyclic group (e.g., furyl, thienyl), an aryloxy group having 8 or less carbon atoms which may be substituted (e.g., chlorophenoxy, phenoxy, hydroxyphenoxy), an acyl group having 8 or less carbon atoms (e.g., benzenesulfonyl, methanesulfonyl, acetyl, propionyl), an alkoxycarbonyl group having 6 or less carbon atoms (e.g., ethoxycarbonyl, butoxycarbonyl), a cyano group, an alkylthio group having 6 or less carbon atoms (e.g., methylthio, ethylthio), an arylthio group having 8 or less carbon atoms which may be substituted (e.g., phenylthio, tolylthio), a carbamoyl group having 8 or less carbon atoms which may be substituted (e.g., carbamoyl, N-ethylcarbamoyl), an amino group, an ammonium group, or an acylamino group having 8 or less carbon atoms (e.g., acetylamino, methanesulfonylamino). The alkylene group may have one or more substituents.

Specific examples of the groups represented by $R_{14}$ include, e.g., methylene, ethylene, trimethylene, allylene, tetramethylene, pentamethylene, hexamethylene, methoxyethylene, ethoxyethylene, ethyleneoxy, ethylenethio, phenethylene, 2-trifluoromethylethylene, 2,2,3,3-tetrafluoroethylene, carbamoylethylene, hydroxyethylene, and 2-(2-hydroxyethoxy)ethylene, preferably methylene, ethylene, trimethylene, tetramethylene, pentamethylene, 3-methyltetramethylene, and ethyleneoxy.

$Y_{11}$ preferably represents an aryl group of condensed 5-membered or less ring or a heterocyclic aromatic group, which may further have a substituent, but an anionic substituent is not included (those described above as examples of anionic substituents can be cited, e.g., a sulfo group or a carboxyl group). Preferred examples of the aryl groups are phenyl, naphthyl, anthracenyl, etc. Preferred examples of the heterocyclic aromatic groups are pyridinium, quinoline, imidazole, benzimidazole, etc. Substituents cited above as preferred substituents for $Z_{11}$ and $Z_{12}$ can be cited as examples of preferred substituents for the aryl and heterocyclic aromatic groups, e.g., a lower alkyl group having 6 or less carbon atoms, e.g., methyl, ethyl, propyl, a halogen atom, a hydroxyl group, an alkoxyl group having 6 or less carbon atoms, an aryl group having 8 or less carbon atoms which may be substituted, a heterocyclic group (e.g., furyl, thienyl), an aryloxy group having 8 or less carbon atoms which may be substituted (e.g., chlorophenoxy, phenoxy, hydroxyphenoxy), an acyl group having 8 or less carbon atoms (e.g., benzenesulfonyl, methanesulfonyl, acetyl, propionyl), an alkoxycarbonyl group having 6 or less carbon atoms (e.g., ethoxycarbonyl, butoxycarbonyl), a cyano group, an alkylthio group having 6 or less carbon atoms (e.g., methylthio, ethylthio), an arylthio group having 8 or less carbon atoms which may be substituted (e.g., phenylthio tolylthio), a carbamoyl group having 8 or less carbon atoms which may be substituted (e.g., carbamoyl, N-ethylcarbamoyl), an amino group, an ammonium group, or an acylamino group having 8 or less carbon atoms (e.g., acetylamino, methanesulfonylamino), and the aryl and heterocyclic aromatic groups may have one or more substituents.

In formula (1), $L_{11}$, $L_{12}$, $L_{13}$, $L_{14}$, $L_{15}$, $L_{16}$ and $L_{17}$ each independently represents a methine group. The methine groups represented by $L_{11}$ to $L_{16}$ each may have a substituent, e.g., a substituted or unsubstituted alkyl group having from 1 to 15, preferably from 1 to 10, and more preferably from 1 to 5, carbon atoms (e.g., methyl, ethyl, 2-carboxyethyl), a substituted or unsubstituted aryl group having from 6 to 20, preferably from 6 to 15, and more preferably from 6 to 10, carbon atoms (e.g., phenyl, o-carboxyphenyl), a substituted or unsubstituted heterocyclic group having from 3 to 20, preferably from 4 to 15, and more preferably from 6 to 10, carbon atoms (e.g., N,N-diethylbarbituric acid), a halogen atom (e.g., chlorine, bromine, fluorine, iodine), an alkoxyl group having from 1 to 15, preferably from 1 to 10, and more preferably from 1 to 5, carbon atoms (e.g., methoxy, ethoxy), an alkylthio group having from 1 to 15, preferably from 1 to 10, and more preferably from 1 to 5, carbon atoms (e.g., methylthio, ethylthio), an aryloxy group having from 6 to 20, preferably from 6 to 15, and more preferably from 6 to 10, carbon atoms (e.g., phenoxy), an arylthio group having from 6 to 20, preferably from 6 to 15, and more preferably from 6 to 10, carbon atoms (e.g., phenylthio), an amino group having from 0 to 15, preferably from 2 to 10, and more preferably from 4 to 10, carbon atoms (e.g., N,N-diphenylamino, N-methyl-N-phenylamino, N-methylpiperazino), etc. $L_{11}$ to $L_{16}$ may form a ring with other methine groups or an auxochrome.

$X_{11}$ represents a charge balancing ion which is necessary for neutralizing an ionic charge of a dye. Examples of representative cations include an inorganic cations such as a hydrogen ion ($H^+$), an alkali metal ion (e.g., a sodium ion, a potassium ion, a lithium ion), and an alkaline earth metal ion (e.g., a calcium ion), and an organic ion such as an ammonium ion (e.g., an ammonium ion, a tetraalkylammonium ion, a pyridinium ion, an ethylpyridinium ion). Anions may be inorganic or organic, e.g., a halogen ion (e.g., a fluoride ion, a chloride ion, an iodide ion), a substituted arylsulfonate ion (e.g., a p-toluenesulfonate ion, a p-chlorobenzenesulfonate ion), an aryldisulfonate ion (e.g., a 1,3-benzenedisulfonate ion, a 1,5-naphthalenedisulfonate ion, a 2,6-naphthalenedisulfonate ion), an alkylsulfate ion (e.g., a methylsulfate ion), a sulfate ion, a thiocyanate ion, a perchlorate ion, a tetrafluoroborate ion, a picrate ion, an acetate ion, or a trifluoromethanesulfonate ion. Anions are preferably used. Further, ionic polymers or other dyes having a counter charge can also be used.

Specific examples of dyes for use in the present invention are shown below.

S-1
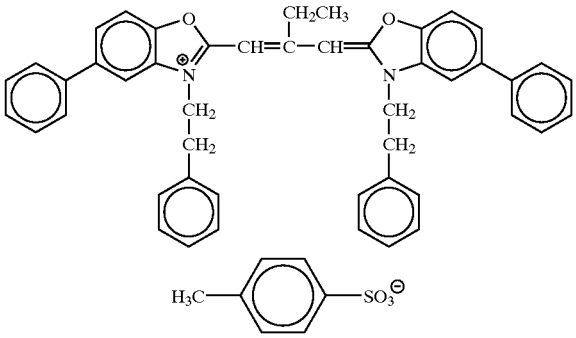
S-2
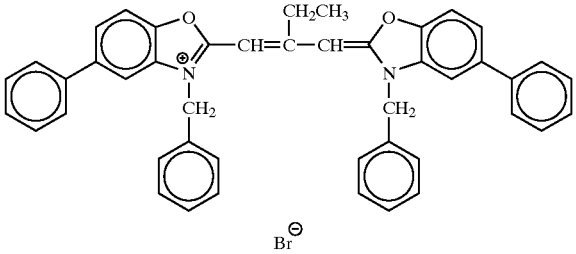
S-3
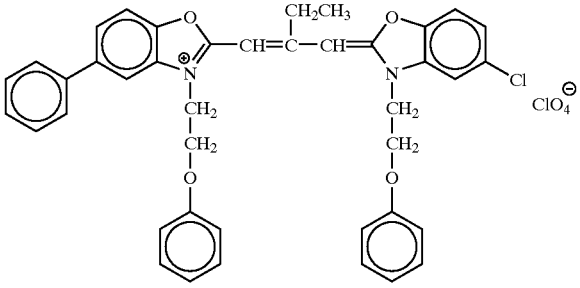
S-4
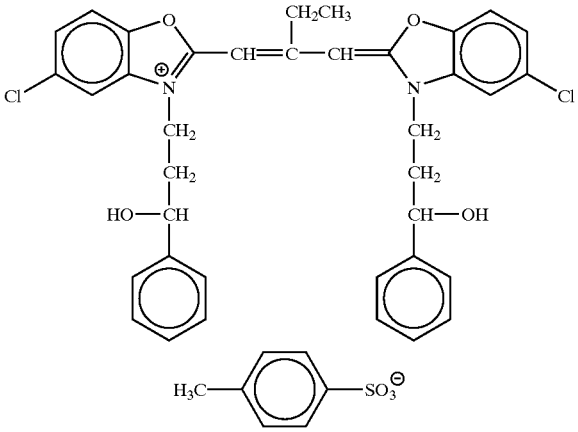
-continued
S-5
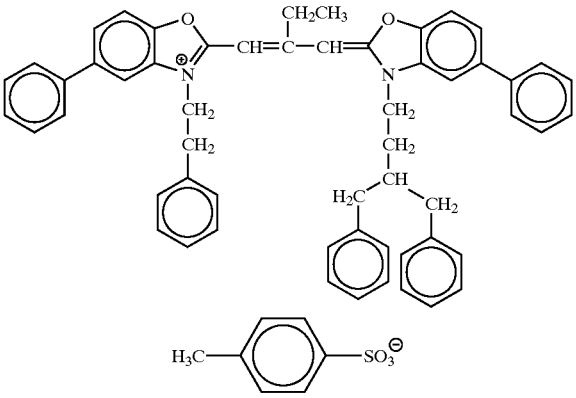
S-6
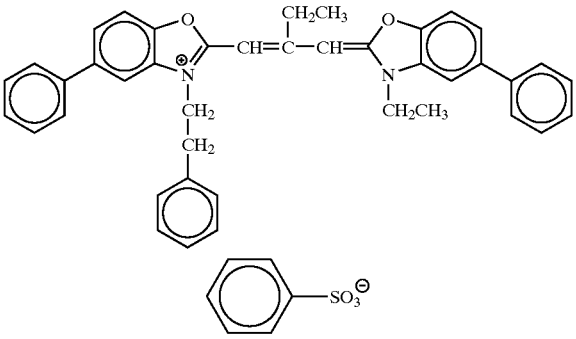
S-7
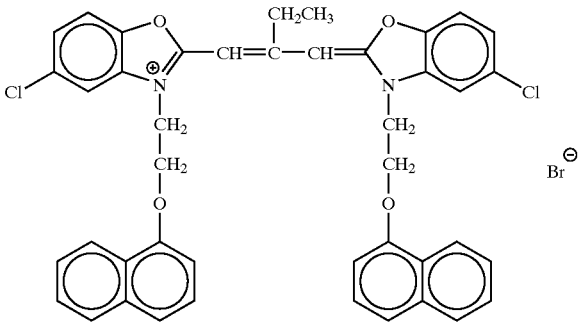
S-8
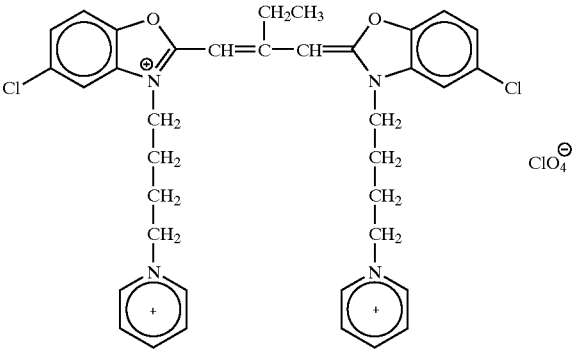

-continued
S-9
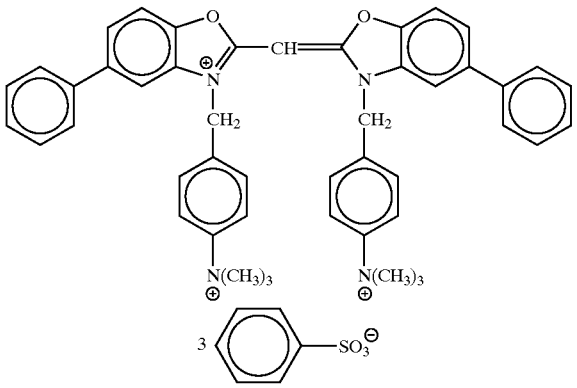
S-10
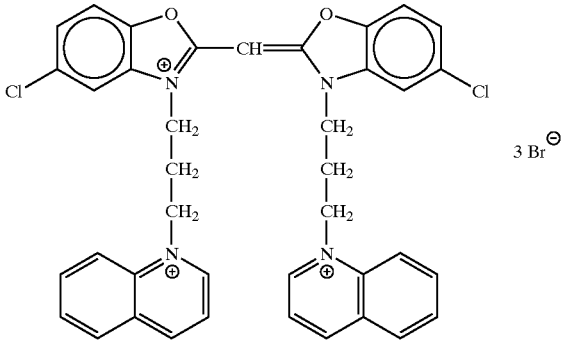
S-11
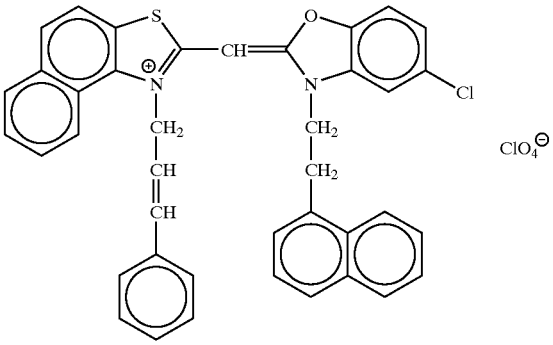
S-12
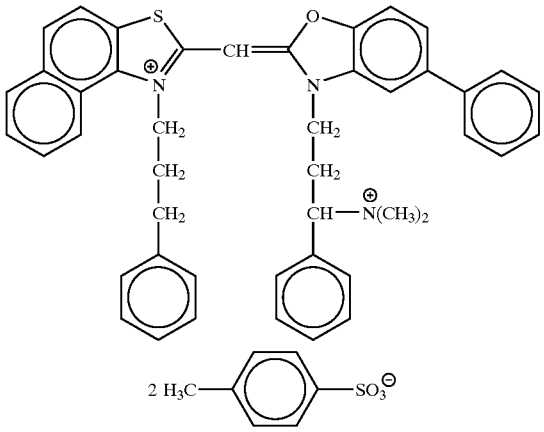
-continued
S-13
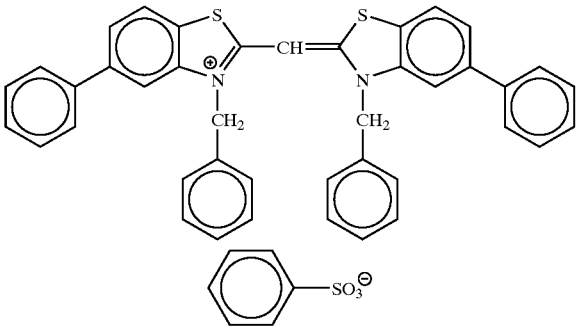
S-14
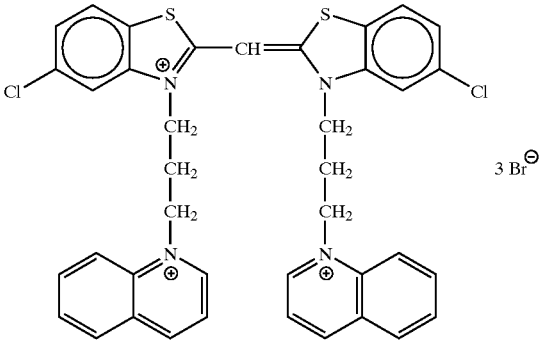
S-15
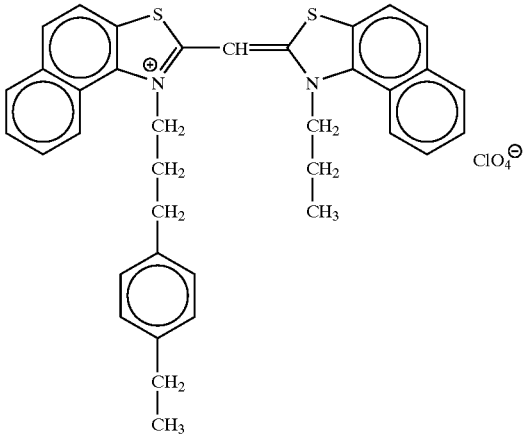
S-16
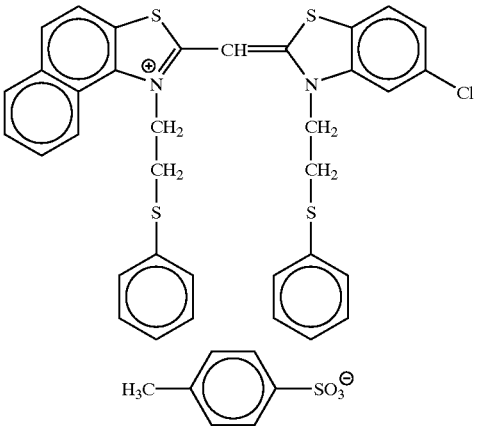

-continued
S-17
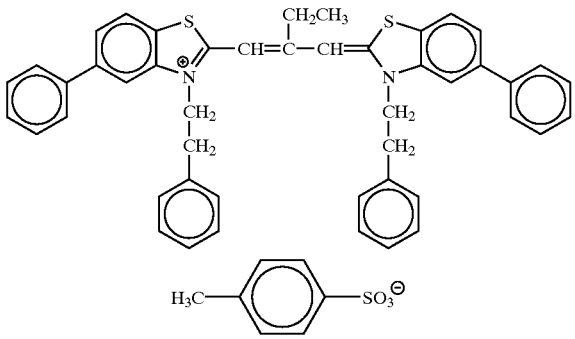
S-18
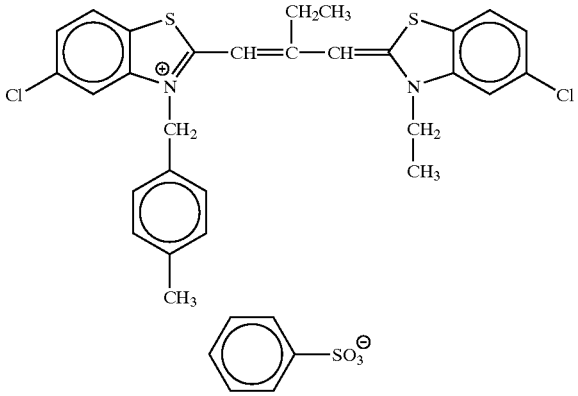
S-19
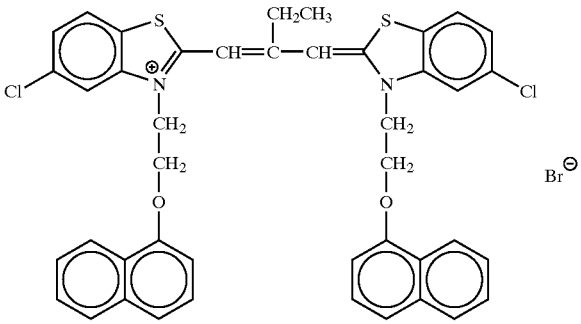
-continued
S-20
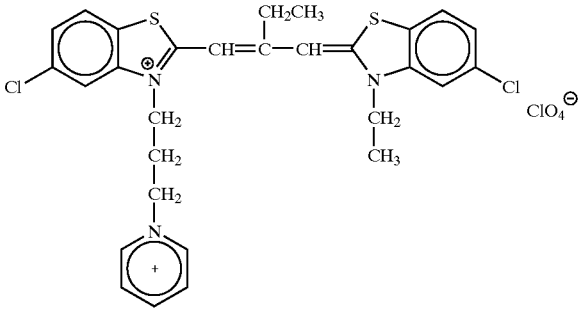
S-21
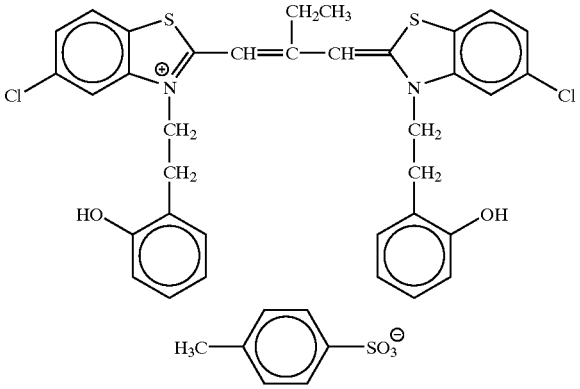
S-22
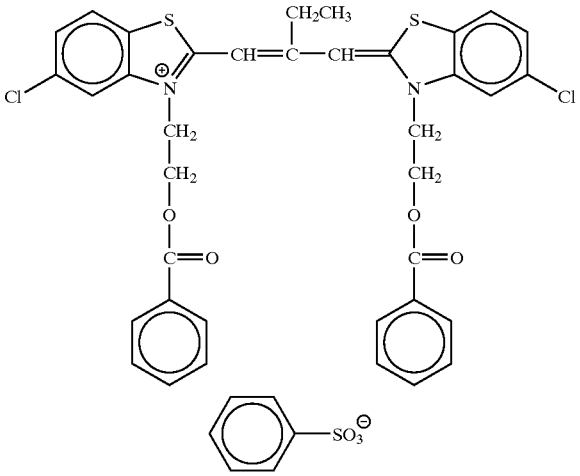

-continued
S-23
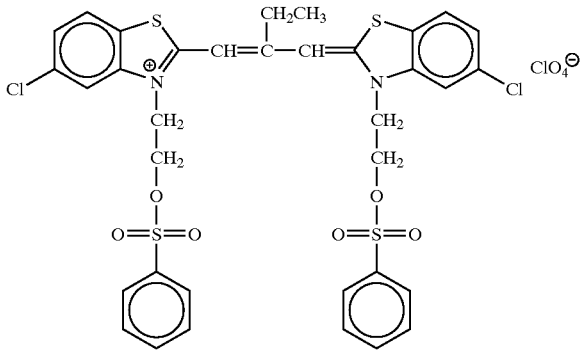
S-24
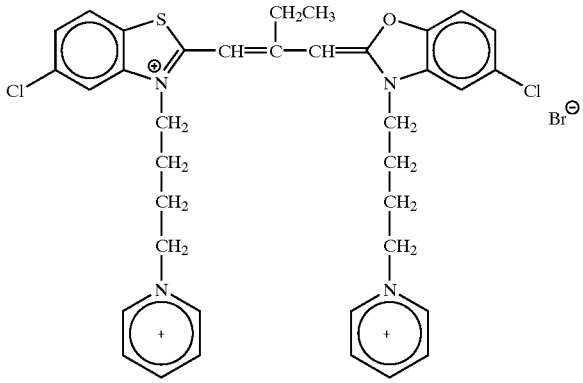
S-25
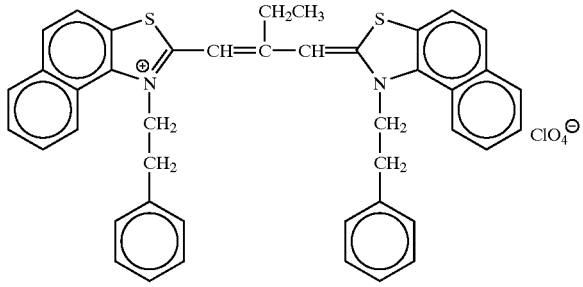
S-26
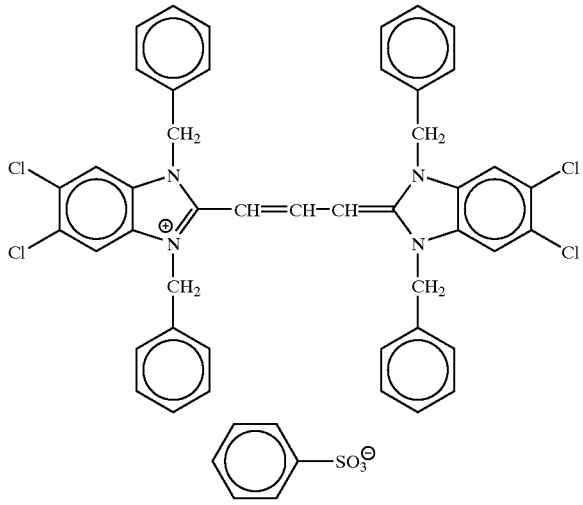
-continued
S-27
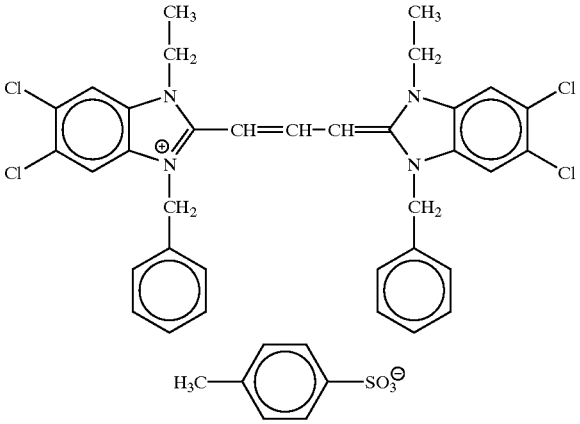
S-28
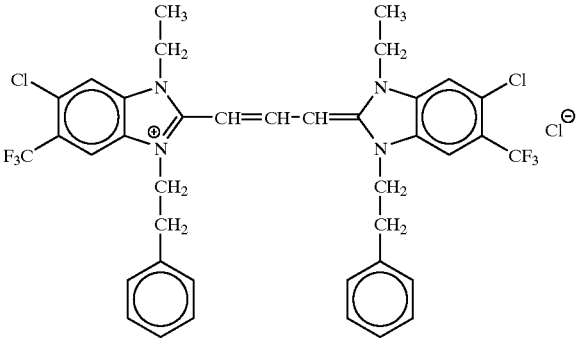
S-29
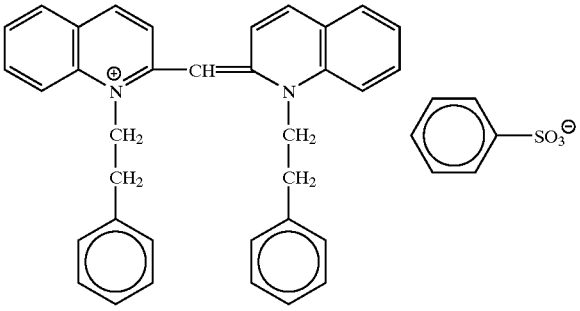

-continued

S-30

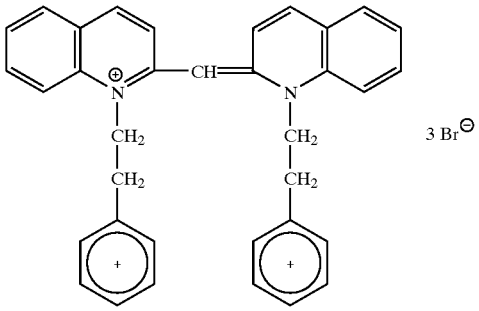

S-31

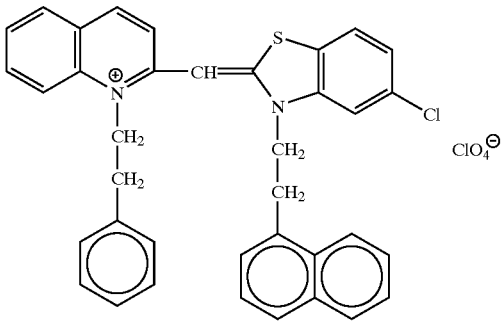

S-32

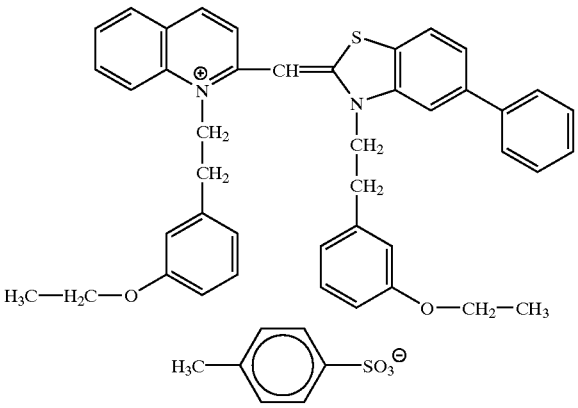

S-33

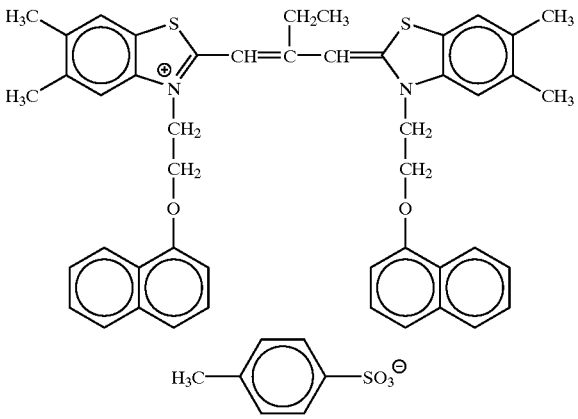

-continued

S-34

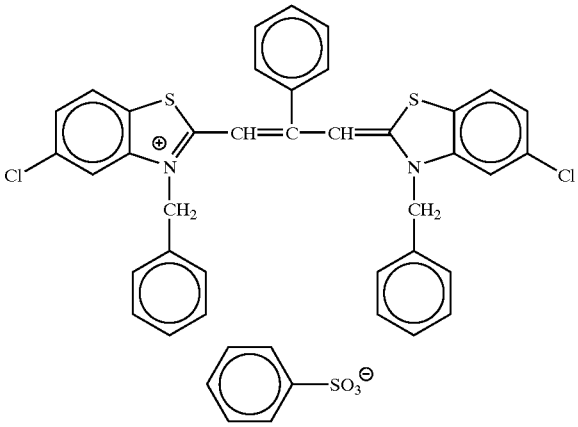

In formula (2), $Z_{21}$ and $Z_{22}$, which may be the same or different, each represents a 5- or 6-membered nitrogen-containing heterocyclic nucleus-forming atomic group, and preferred nitrogen-containing heterocyclic rings formed by $Z_{11}$ and $Z_{12}$ cited above can be cited as preferred nitrogen-containing heterocyclic rings formed by $Z_{21}$ and $Z_{22}$. The nitrogen-containing heterocyclic nuclei represented by $Z_{21}$ and $Z_{22}$ may have one or more substituents, and those cited above as preferred substituents for $Z_{11}$ and $Z_{12}$ can be cited as examples of preferred substituents for $Z_{21}$ and $Z_{22}$. As specific examples of the nitrogen-containing heterocyclic nuclei represented by $Z_{21}$ and $Z_{22}$, those cited above as specific examples of the nitrogen-containing heterocyclic nuclei represented by $Z_{11}$ and $Z_{12}$ can be cited.

$R_{21}$ and $R_{22}$ each represents an alkyl group, provided that it is essential for both $R_{21}$ and $R_{22}$ to have at least one anionic substituent (those enumerated above as examples of anionic substituents can be cited, e.g., a sulfo group or a carboxyl group).

As examples of preferred alkyl groups, the same alkyl groups as preferred alkyl groups represented by $R_{11}$ and $R_{12}$ in formula (1) can be mentioned.

At least one of $R_{21}$ and $R_{22}$ is preferably represented by $R_{23}$, and more preferably each of $R_{21}$ and $R_{22}$ is represented by $R_{23}$. $R_{24}$ in $R_{23}$ represents a single bond or a divalent linking group, and as preferred linking groups thereof, the same linking groups cited as preferred linking groups represented by $R_{14}$ can be cited except that $R_{24}$ may have an anionic substituent (those described above as examples of anionic substituents can be mentioned, e.g., a sulfo group or a carboxyl group).

$Y_{21}$ represents an aryl group or a heterocyclic aromatic group, and as preferred aryl groups and heterocyclic groups, the same aryl groups and heterocyclic groups cited as preferred aryl groups and heterocyclic groups represented by $Y_{11}$ can be cited except that $Y_{21}$ may have an anionic substituent (those described above as examples of anionic substituents can be mentioned, e.g., a sulfo group or a carboxyl group). In $R_{23}$, the position of substitution of an anionic substituent may be either of $R_{24}$ or $Y_{21}$, or both may be substituted with anionic substituents. Moreover, either one of $R_{24}$ or $Y_{21}$ may have a plurality of anionic substituents.

$L_{21}$, $L_{22}$, $L_{23}$, $L_{24}$, $L_{25}$, $L_{26}$ and $L_{27}$ each independently represents a methine group. The methine groups represented by $L_{21}$ to $L_{26}$ each may have a substituent, e.g., and as preferred substituents, those cited above as preferred substituents represented by $L_{11}$ to $L_{16}$ can be cited. $L_{21}$ to $L_{26}$ may form a ring with other methine groups or an auxochrome.

$X_{21}$ represents a charge balancing ion which is necessary for neutralizing an ionic charge of a dye. Those cited as examples of $X_{11}$ can be used as a charge balancing ion. Cations are preferably used. $m_{21}$ represents a number of from 0 to 8 necessary for neutralizing a charge in the molecule.

Specific examples of dyes for use in the present invention are shown below.

S-35

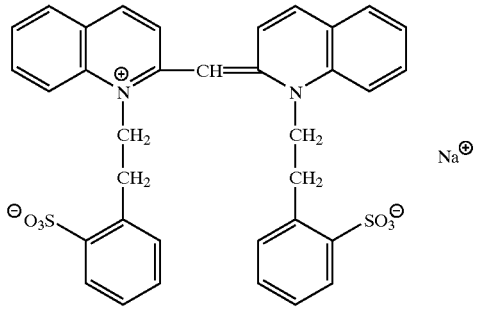

S-36

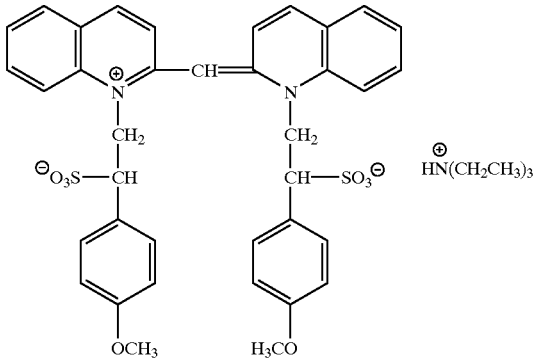

-continued

S-37

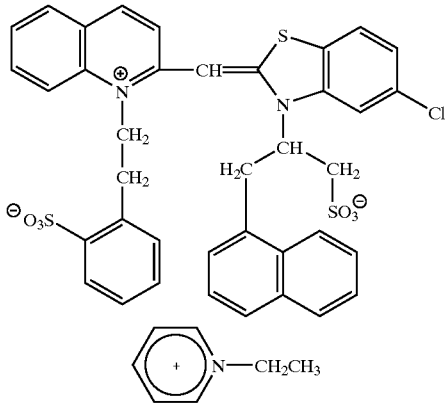

S-38

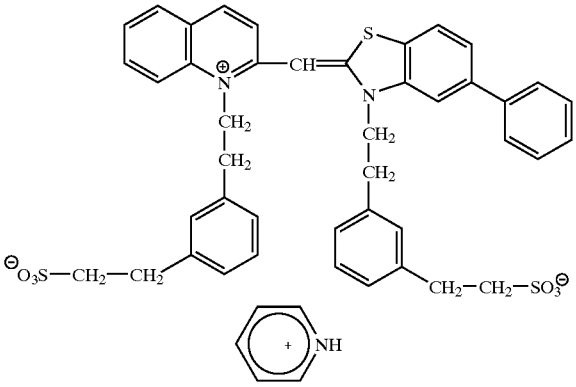

S-39

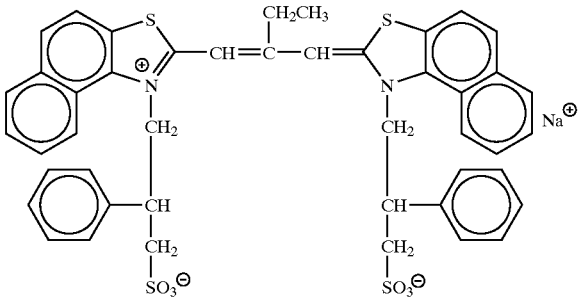

-continued
S-40
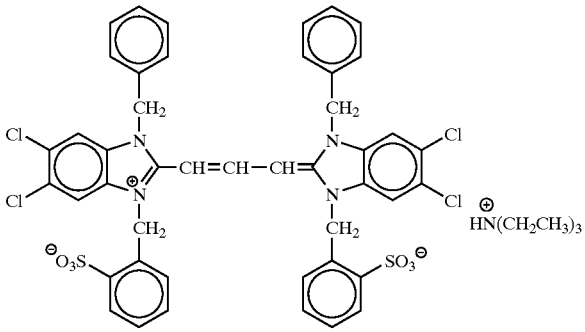
S-41
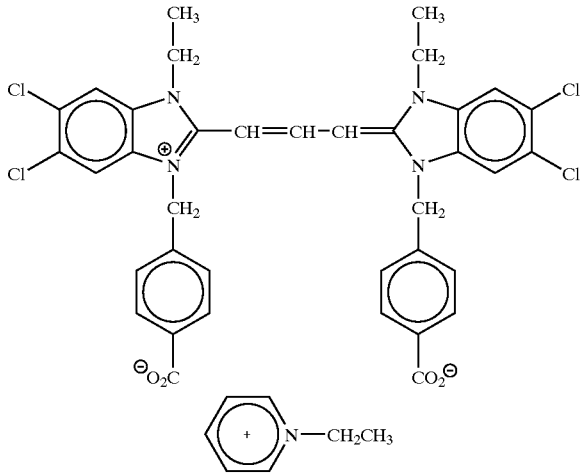
S-42
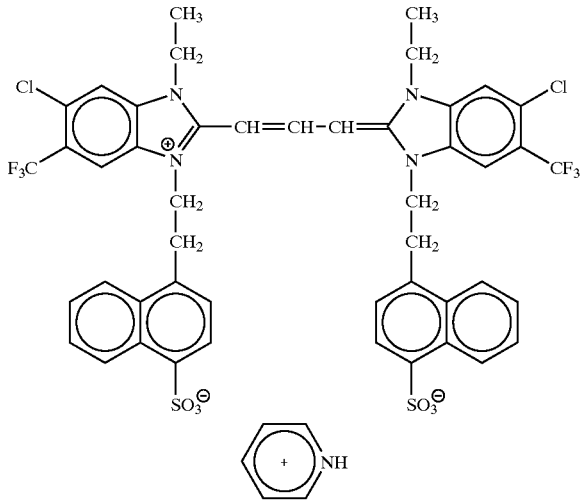
-continued
S-43
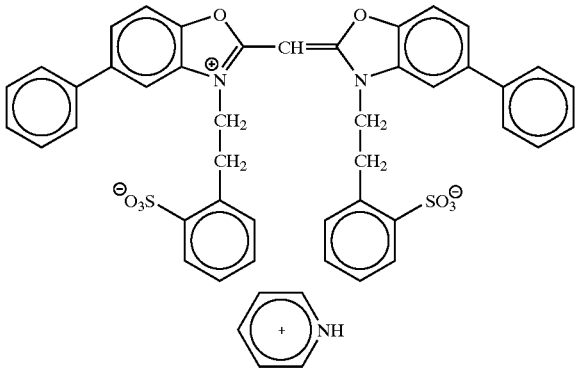
S-44
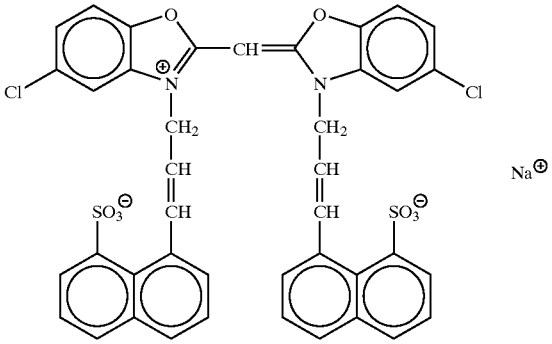
S-45
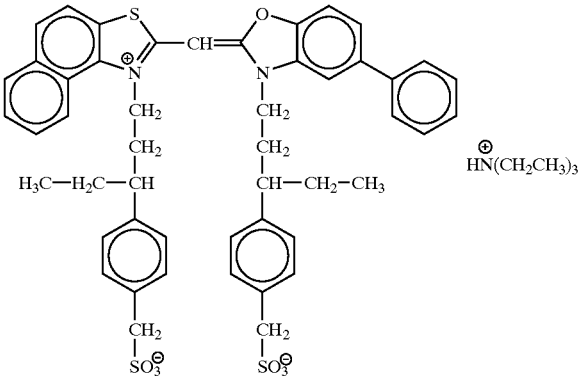
S-46
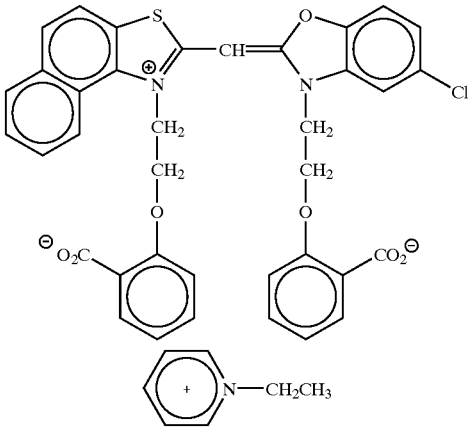

-continued
S-47
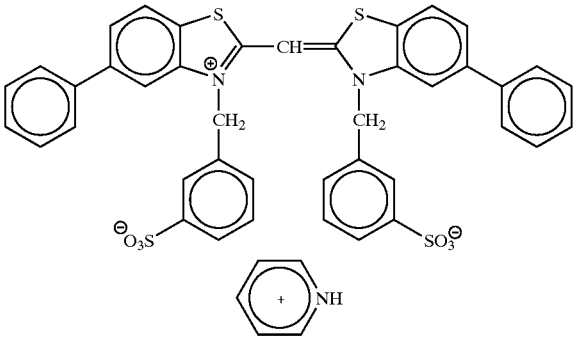
S-48
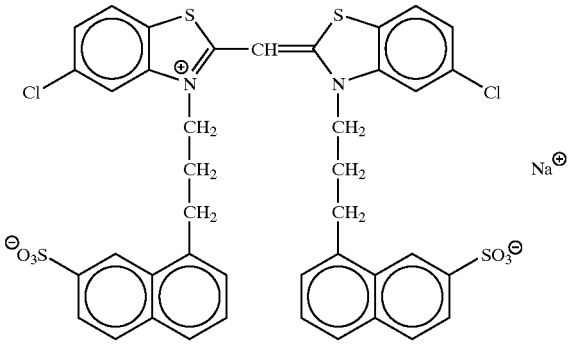
S-49
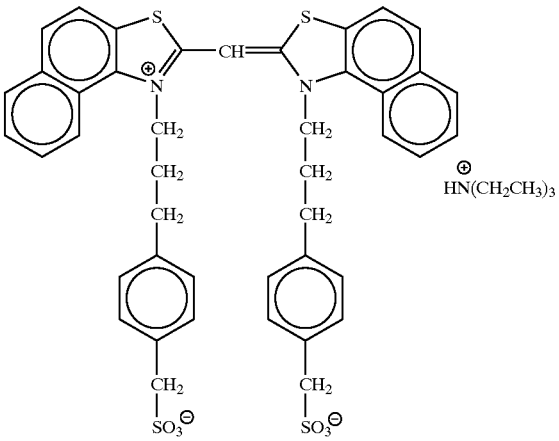
-continued
S-50
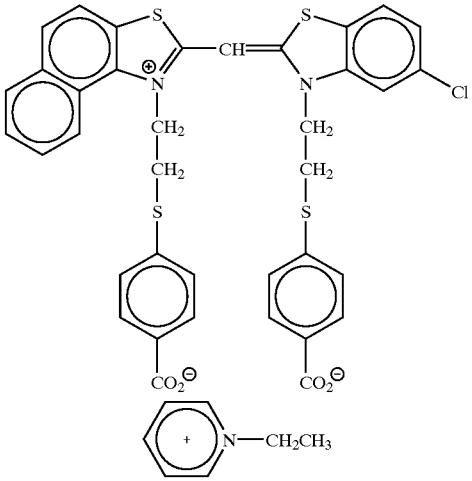
S-51
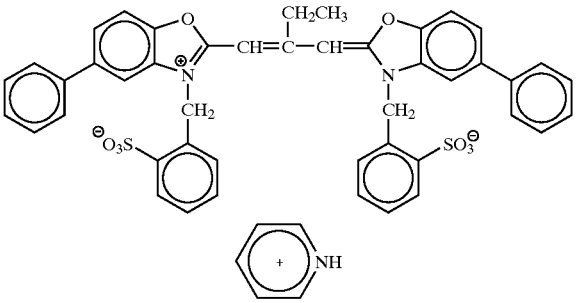
S-52
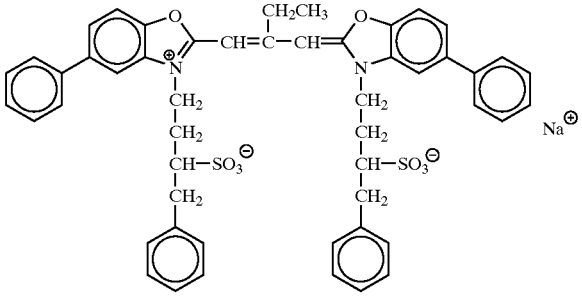
S-53
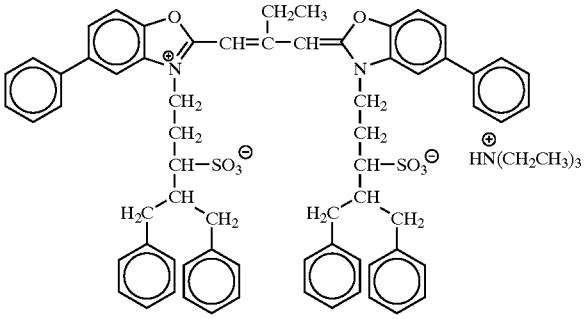

-continued
S-54
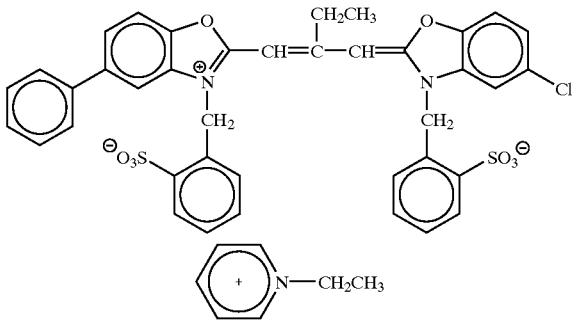
S-55
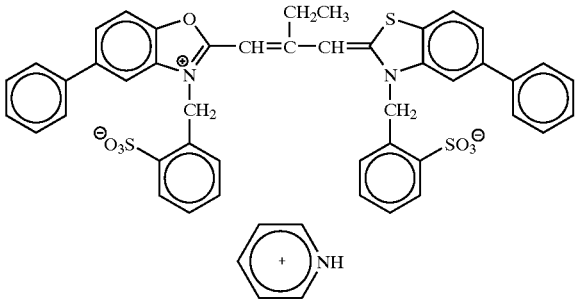
S-56
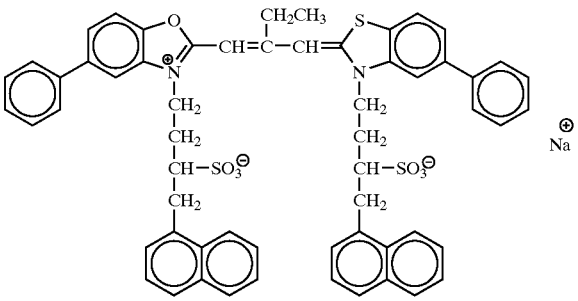
S-57
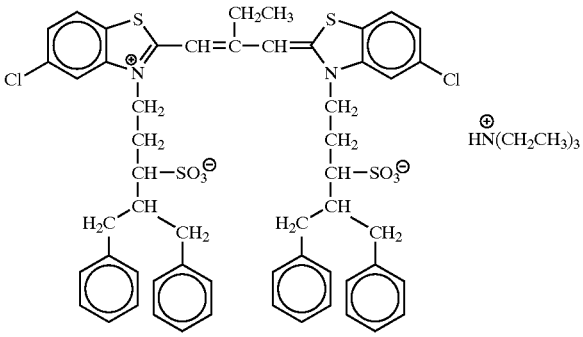
-continued
S-58
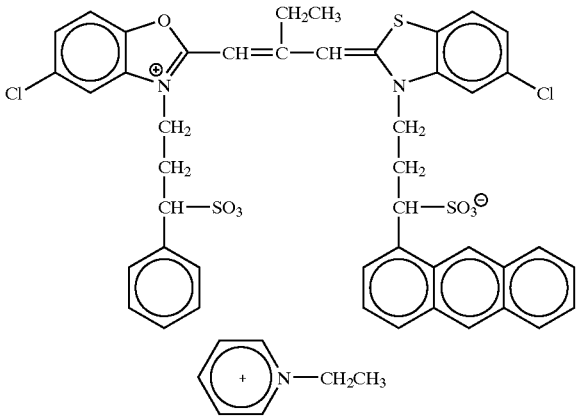
S-59
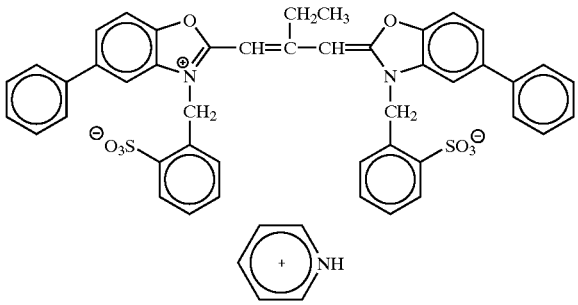
S-60
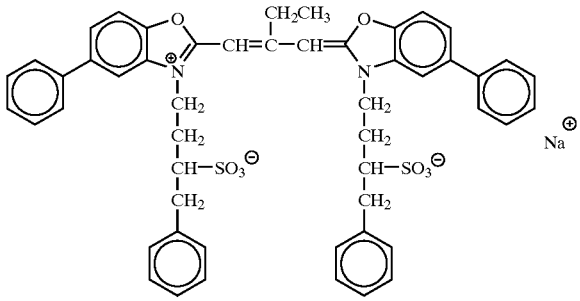
S-61
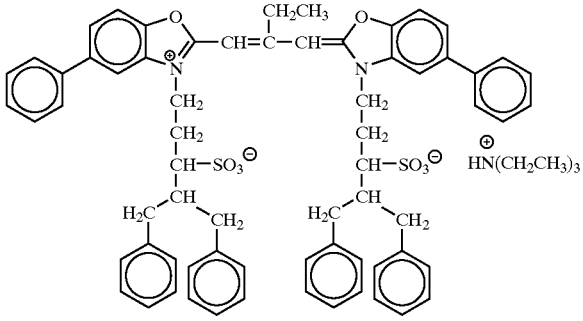

-continued
S-62
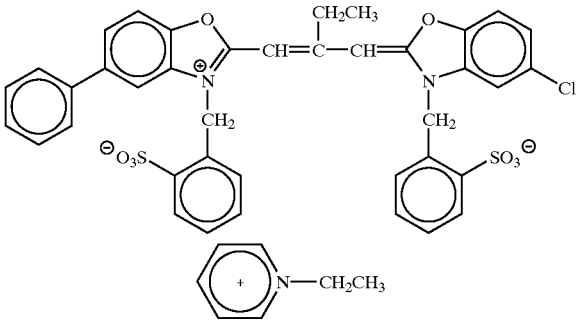
S-63
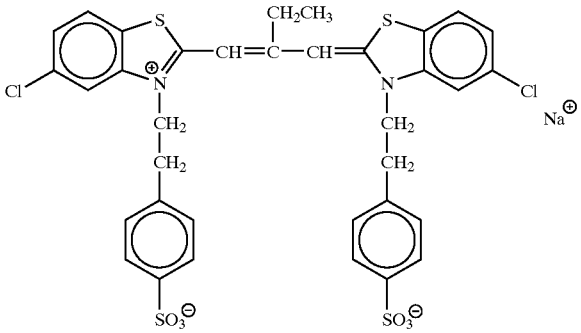
S-64
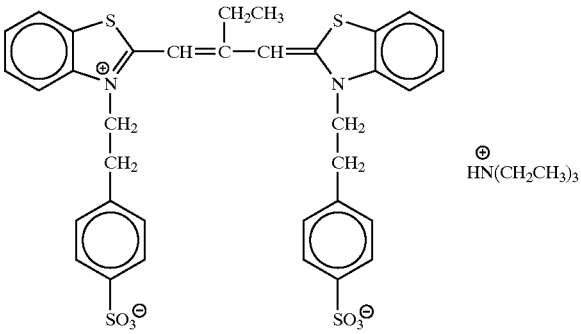
S-65
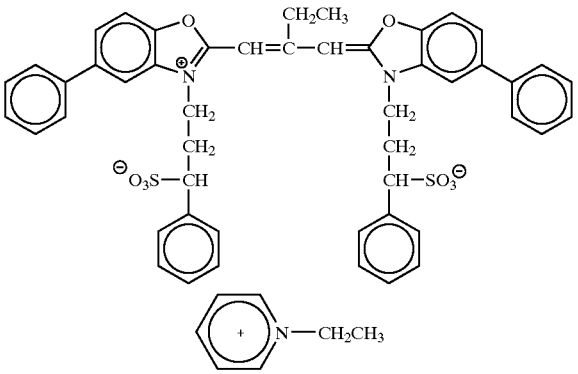
-continued
S-66
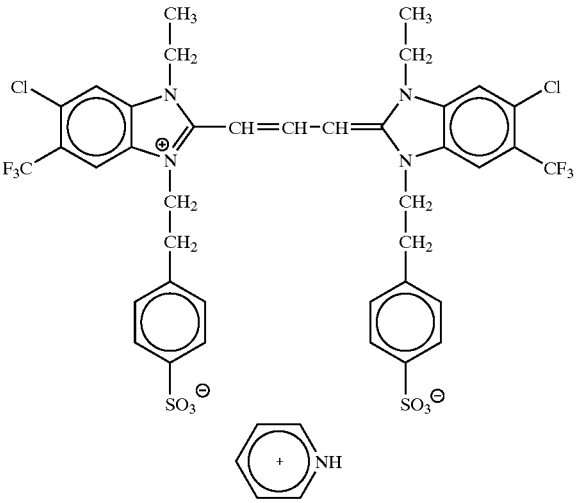
S-67
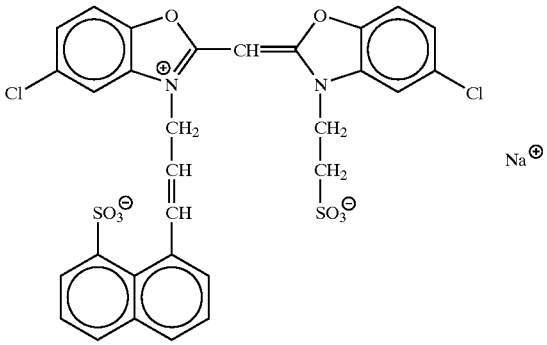
S-68
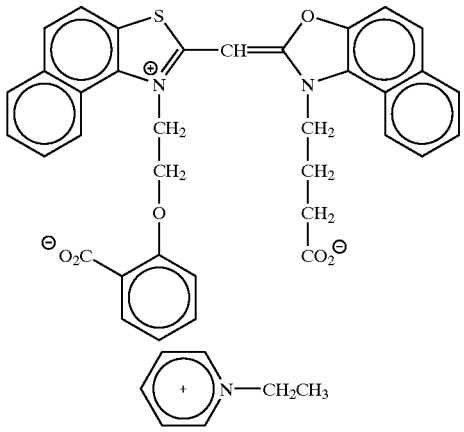

-continued

S-69

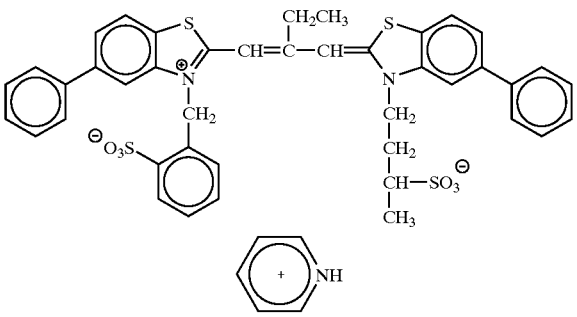

S-70

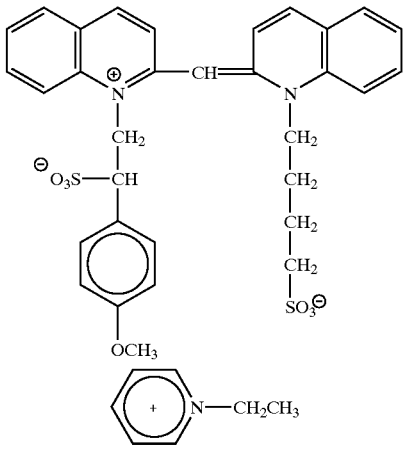

The structure of a sensitizing dye is not particularly limited in the present invention, and a cyanine dye, a merocyanine dye, a complex cyanine dye, a holopolar cyanine dye, a hemicyanine dye, a styryl dye, and a hemioxonol dye can be used. Of the above dyes, a particularly useful sensitizing dye is a cyanine dye for the present invention.

Nuclei which are usually utilized as basic heterocyclic nuclei in cyanine dyes can be applied to these dyes. For example, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; the above nuclei to which alicyclic hydrocarbon rings are fused; the above nuclei to which aromatic hydrocarbon rings are fused, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus can be applied. These heterocyclic nuclei may be substituted on the carbon atoms.

As a nucleus having a ketomethylene structure, a 5- or 6-membered heterocyclic nucleus, such as a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, or a 2-thioselenazoline-2,4-dione can be applied to a merocyanine dye or a complex merocyanine dye.

For example, the compounds described in *Research Disclosure*, 17643, p. 23, Item IV (December, 1978), or compounds described in the literature cited therein can be used.

Specifically, the following compounds (dyes) can be used.

a: 5,5'-Dichloro-3,3'-diethylcyanine bromide b: 5,5'-Dichloro-3,3'-di(4-sulfobutyl)thiacyanine Na salt c: 5-Methoxy-4,5-benzo-3,3'-di(3-sulfopropyl) thiacyanine Na salt d: 5,5'-Dichloro-3,3'-diethylselenacyanine iodide e: 5,5'-Dichloro-9-ethyl-3,3'-di(3-sulfopropyl)-thiacarbocyanine pyridinium salt f: Anhydro-5,5'-dichloro-9-ethyl-3-(4-sulfobutyl)-3'-ethyl hydroxide g: 1,1-Diethyl-2,2'-cyanine bromide h: 1,1-Dipentyl-2,2'-cyanine perchloric acid i: 9-Methyl-3,3'-di(4-sulfobutyl)thiacarbocyanine pyridinium salt j: 5,5'-Diphenyl-9-ethyl-3,3'-di(2-sulfoethyl)-oxacarbocyanine Na salt k: 5-Chloro-5'-phenyl-9-ethyl-3-(3-sulfopropyl)-3'-(2-sulfoethyl)oxacarbocyanine Na salt l: 5,5'-Dichloro-9-ethyl-3,3'-di(3-sulfopropyl)-oxacarbocyanine Na salt m: 5,5'-Dichloro-6,6'-dichloro-1,1'-diethyl-3,3'-di(3-sulfopropyl)imidacarbocyanine Na salt n: 5,5'-Diphenyl-9-ethyl-3,3'-di(3-sulfopropyl)-thiacarbocyanine Na salt For the inclusion of the sensitizing dyes for use in the present invention in the silver halide photographic emulsion of the present invention, they may be directly dispersed in the emulsion, or they may be dissolved in water, a single or mixed solvent of methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, acetonitrile, tetrahydrofuran, N,N-dimethylformamide, etc., and then added to the emulsion.

In addition, various methods can be used for the inclusion of the sensitizing dyes in the emulsion, for example, a method in which dyes are dissolved in a volatile organic solvent, the solution is dispersed in water or hydrophilic colloid and this dispersion is added to the emulsion as disclosed in U.S. Pat. No. 3,469,987, a method in which water-insoluble dyes are dispersed in a water-soluble solvent without being dissolved and this dispersion is added to the emulsion as disclosed in JP-B-46-24185 (the term "JP-B" as used herein means an "examined Japanese patent publication"), a method in which dyes are dissolved in acid and the solution is added to the emulsion, or dyes are added to the emulsion as an aqueous solution coexisting with acid or base as disclosed in JP-B-44-23389, JP-B-44-27555 and JP-B-57-22091, a method in which dyes are added to the emulsion as an aqueous solution or colloidal dispersion coexisting with a surfactant as disclosed in U.S. Pat. Nos. 3,822,135 and 4,006,025, a method in which dyes are directly dispersed in a hydrophilic colloid and the dispersion is added to the emulsion as disclosed in JP-A-53-102733 and JP-A-58-105141, or a method in which dyes are dissolved using a compound capable of red-shifting and the solution is added to the emulsion as disclosed in JP-A-51-74624 can be used.

Further, ultrasonic waves can be used for dissolution.

The sensitizing dyes represented by formulae (1) and (2) for use in the present invention can be synthesized by referring to, for example, JP-A-52-104917, JP-B-43-25652, JP-B-57-22368, F. M. Hamer, *The Chemistry of Heterocyclic Compounds*, Vol. 18, *The Cyanine Dyes and Related Compounds*, A. Weissberger ed., *Interscience*, New York, 1964, D. M. Sturmer, *The Chemistry of Heterocyclic*

*Compounds*, Vol. 30, A. Weissberger and E. C. Taylor ed., John Wiley, New York, p. 441, and JP-A-270,164.

It is preferred that 30% or more of the total addition amount of the sensitizing dyes for use in the present invention is anionic cyanine dyes and 30% or more is present invention is anionic cyanine dyes and 30% or more is cationic cyanine dyes.

Several kinds of dyes can be previously mixed and added to an emulsion but cationic cyanine dyes and anionic cyanine dyes are preferably added differently. Further, preferably cationic cyanine dyes are added first, more preferably cationic dyes represented by formula (1) are added in an amount equivalent to the amount of 80% or more of the saturated coated amount, subsequently anionic cyanine dyes are added, and particularly preferably cationic dyes represented by formula (1) are added in an amount equivalent to the amount of 80% or more of the saturated coated amount, then anionic cyanine dyes represented by formula (2) are added in an amount equivalent to the amount of 50% or more of the saturated coated amount.

When dyes are added differently, the fluorescent yield of the later added dye in a gelatin dry film is preferably 0.5 or more, more preferably 0.8 or more.

It is also preferred that the reduction potential of the dye added later is equal to or base than that of the dye added first, more preferably the reduction potential of the dye added later is base by 0.03 V or more than that of the dye added first. Further, it is preferred that the oxidation potential of the dye added later is base by 0.01 V or more than that of the dye added first, more preferably by 0.03 V or more.

Dyes may be added at any time of the emulsion preparation. The addition temperature of dyes may be any degree but the emulsion temperature at the time of dye addition is preferably from 10° C. to 75° C., and particularly preferably from 30° C. to 65° C.

The emulsion for use in the present invention may not be chemically sensitized but is preferably chemically sensitized. The total addition amount of dyes may be added before chemical sensitization or after chemical sensitization, but optimal chemical sensitization can be obtained by conducting chemical sensitization after a part of the dye is added and adding the remaining part of the dyes after the chemical sensitization.

As chemical sensitizing methods, a gold sensitizing method using gold compounds (e.g., U.S. Pat. Nos. 2,448,060, 3,320,069), a sensitizing method using metals such as iridium, platinum, rhodium, palladium, etc, (e.g., U.S. Pat. Nos. 2,448,060, 2,566,245, 2,566,263), a sulfur sensitizing method using sulfur-containing compounds (e.g., U.S. Pat. No. 2,222,264), a selenium sensitizing method using selenium compounds, or a reduction sensitizing method using tin salts, thiourea dioxide, polyamine, etc. (e.g., U.S. Pat. Nos. 2,487,850, 2,518,698, 2,521,925) can be used alone or in combination of two or more.

For the silver halide photographic emulsion of the present invention, gold sensitization or sulfur sensitization, or a combination of them is preferred. The preferred addition amount of a gold sensitizer and a sulfur sensitizer is from $1\times10^{-7}$ to $1\times10^{-2}$ mol, more preferably from $5\times10^{-6}$ to $1\times10^{-3}$ mol, per mol of the silver, respectively. The preferred proportion of a gold sensitizer to a sulfur sensitizer in the case of a combined use of gold sensitization and sulfur sensitization is 1/3 to 3/1, and more preferably 1/2 to 2/1, in molar ratio.

The temperature of chemical sensitization of the present invention can be arbitrarily selected between 30° C. and 90° C. The pH at chemical sensitization is from 4.5 to 9.0, preferably from 5.0 to 7.0. The time of chemical sensitization cannot be determined unconditionally as it varies depending upon the temperature, the kind and the amount of the chemical sensitizer, pH, etc., but can be arbitrarily selected between several minutes and several hours, generally from 10 minutes to 200 hours.

As silver halide for the photographic emulsion which rules light sensitive mechanism in the present invention, any silver halide such as silver bromide, silver iodobromide, silver chlorobromide, silver iodide, silver iodochloride, silver iodobromochloride, and silver chloride can be used, but by using silver halide having the halogen composition of the outermost surface of the emulsion of iodide content of 0.1 mol % or more, more preferably 1 mol % or more, and particularly preferably 5 mol % or more, stronger multilayer adsorption structure can be constructed.

Grain size distribution may be broad or narrow, but narrow distribution is preferred.

Silver halide grains in a photographic emulsion may have a regular crystal form such as a cubic, octahedral, tetradecahedral, or rhombic dodecahedral form, an irregular crystal form such as a spherical or plate-like form, a form which has higher planes such as {hkl} plane, or a form which is a composite of grains having these forms, but tabular grains having an aspect ratio of 10 or more, more preferably 20 or more, are preferably used. An aspect ratio is defined as the value obtained by dividing the equivalent-circle diameter by the thickness of a grain. With respect to grains having higher planes, *Journal of Imaging Science*, Vol. 30, pp. 247 to 254 (1986) can be referred to.

Silver halide photographic emulsions for use in the present invention may comprise alone or the mixtures of two or more of these grains. The interior and the surface layer of silver halide grains may be comprised of different phases, grains may be a multiphase structure having a joined structure, may have a local phase on the grain surface, may be comprised of uniform phase, or may be the mixtures of these forms.

These various types of emulsions may be of the superficial latent image type wherein the latent image is primarily formed on the surface, or of the internal latent image type wherein the latent image is formed within the grains.

The photographic emulsions for use in the present invention can be prepared using the methods disclosed, for example, in P. Glafkides, *Chimie et Physique Photographique*, Paul Montel (1967), G. F. Duffin, *Photographic Emulsion Chemistry*, Focal Press (1966), V. L. Zelikman et al., *Making and Coating Photographic Emulsion*, Focal Press (1964), F. H. Claes et al., *The Journal of Photographic Science*, (21) 39–50 (1973), F. H. Claes et al., ibid., (21) 85–92 (1973), JP-B-55-42737, U.S. Pat. Nos. 4,400,463, 4,801,523, JP-A-62-218959, JP-A-63-213836, JP-A-63-218938, and Japanese Patent Application No. 62-291487. That is, any of an acid process, a neutral process and an ammoniacal process may be used. Any of a single jet method, a double jet method and a combination of these methods can be used for the reaction of a soluble silver salt with a soluble halide. A method in which grains are formed in the presence of excess silver ions (a so-called reverse mixing method) can also be used. A method in which the pAg in the liquid phase in which the silver halide is formed is kept constant, that is, the controlled double jet method, can also be used as one type of the double jet method. A silver halide photographic emulsion having a regular crystal form and an almost uniform grain size can be obtained with this method.

Further, an emulsion prepared by a so-called conversion method which contains the process of converting grains to silver halide already formed until the termination of the silver halide grain formation process, or an emulsion subjected to the same halogen conversion after the termination of the silver halide grain formation process can also be used.

In the preparation of silver halide grains for use in the present invention, a silver halide solvent may be used.

As silver halide solvents which are frequently used, for example, thioether compounds (e.g., disclosed in U.S. Pat. Nos. 3,271,157, 3,574,628, 3,704,130, 4,276,347), thione compounds and thiourea compounds (e.g., disclosed in JP-A-53-144319, JP-A-53-82408, JP-A-55-77737), and amine compounds (e.g., disclosed in JP-A-54-100717) can be cited and these can be used in the present invention. In addition, ammonia can also be used within the range not being accompanied by a mal-effect.

A method in which the feeding rate, the addition amount and the addition concentration of a silver salt solution (e.g., a silver nitrate solution) and a halide solution (e.g., a sodium chloride solution) to be added are increased on time schedule with a view to accelerating the grain growth is preferably used in the preparation of silver halide grains. With respect such methods, e.g., British Patent 1,335,925, U.S. Pat. Nos. 3,672,900, 3,650,757, 4,242,445, JP-A-55-142329, JP-A-55-158124, JP-A-55-113927, JP-A-58-113928, JP-A-58-111934, JP-A-58-111936, etc., can be referred to.

During the process of forming silver halide grains or physical ripening, cadmium salts, zinc salts, lead salts, thallium salts, rhenium salts, ruthenium salts, iridium salts or complex salts thereof, rhodium salts or complex salts thereof, iron salts or complex salts thereof may be present. Rhenium salts, iridium salts, rhodium salts and iron salts are particularly preferred.

The addition amount thereof can be arbitrarily selected according to necessity, for example, the preferred addition amount of an iridium salt (e.g., $Na_3IrCl_6$, $Na_2IrCl_6$, $Na_3Ir(CN)_6$, etc.) is from $1\times10^{-8}$ to $1\times10^{-5}$ mol, per mol of the silver, and that of a rhodium salt (e.g., $RhCl_3$, $K_3Rh(CN)_6$, etc.) is from $1\times10^{-8}$ to $1\times10^{-6}$ mol, per mol of the silver.

Various color couplers can be used in the present invention, and specific examples are disclosed in the patents cited in the above *Research Disclosure*, No. 17643, VII-C to G and ibid., No. 307105, VII-C to G. Non-diffusible couplers having a hydrophobic group called a ballast group or polymerized couplers are preferably used. Couplers may be either 2-equivalent or 4-equivalent to a silver ion. Colored couplers which have the effect of correcting colors or couplers which release development inhibitors upon development reaction (so-called DIR couplers) may be contained. Further, colorless DIR coupling compounds which produce a colorless coupling reaction product and release a development inhibitor may be contained.

Examples of preferred cyan couplers for use in the present invention include, e.g., naphthol based couplers and phenol based couplers, and preferred are those disclosed in U.S. Pat. Nos. 2,369,929, 2,772,162, 2,801,171, 2,895,826, 3,446,622, 3,758,308, 3,772,002, 4,052,212, 4,126,396, 4,146,396, 4,228,233, 4,254,212, 4,296,199, 4,296,200, 4,327,173, 4,333,999, 4,334,011, 4,343,011, 4,427,767, 4,451,559, 4,690,889, 4,775,616, West German Patent Publication No. 3,329,729, EP-A-121365, EP-A-249453, and JP-A-61-42658.

As magenta couplers, imidazo[1,2-b]pyrazoles disclosed in U.S. Pat. No. 4,500,630 and pyrazolo[1,5-b]-[1,2,4] triazoles disclosed in U.S. Pat. No. 4,540,654 are particularly preferably used. Other preferred magenta couplers include pyrazolotriazole couplers in which a branched alkyl group is directly bonded to the 2-3- or 6-position of the pyrazolotriazole ring disclosed in JP-A-61-65245, pyrazoloazole couplers having a sulfonamido group in the molecule disclosed in JP-A-61-65246, pyrazoloazole couplers having an alkoxyphenylsulfonamido ballast group disclosed in JP-A-61-147254, and pyrazolotriazole couplers having an alkoxyl group or an aryloxy group at the 6-position disclosed in European Patents (Publication) 226849 and 294785, in addition, couplers disclosed in U.S. Pat. Nos. 3,061,432, 3,725,067, 4,310,619, 4,351,897, 4,556,630, European Patent 73636, JP-A-55-118034, JP-A-60-35730, JP-A-60-43659, JP-A-60-185951, JP-A-61-72238, WO 88/04795, *Research Disclosure*, No. 24220 and ibid. No. 24230 are more preferably used.

Preferred yellow couplers are those disclosed, for example, in U.S. Pat. Nos. 3,933,501, 3,973,968, 4,022,620, 4,248,961, 4,314,023, 4,326,024, 4,401,752, 4,511,649, EP-A-249473, JP-B-58-10739, British Patents 1,425,020, and 1,476,760, and the use pivaloylacetanilide is more preferred.

The above-described couplers which can be preferably used in the present invention are the same as those disclosed in detail in JP-A-2-248945 as preferred couplers, and as specific examples of the above couplers which can preferably be used in the present invention, specific examples of couplers disclosed in JP-A-2-248945, pp. 22 to 29 can be cited.

Typical examples of polymerized dye-forming couplers are disclosed in U.S. Pat. Nos. 3,451,820, 4,080,211, 4,367,282, 4,409,320, 4,576,910, EP-A-341188 and British Patent 2,102,137 and they are more preferably used.

The couplers disclosed in U.S. Pat. No. 4,366,237, European Patent 96570, British Patent 2,125,570, and West German Patent Publication No. 3,234,533 are preferred as couplers the colored dyes of which have an appropriate diffusibility.

The preferred colored couplers for correcting the unnecessary absorption of colored dyes are disclosed in the patents described in *Research Disclosure*, No. 17643, item VII-G, ibid., No. 307105, item VII-G, U.S. Pat. Nos. 4,004,929, 4,138,258, 4,163,670, British Patent 1,146,368, and JP-B-57-39413. Moreover, it is also preferred to use couplers for correcting the unnecessary absorption of colored dyes by fluorescent dyes released upon coupling disclosed in U.S. Pat. No. 4,774,181, and couplers having a dye precursor group capable of forming a dye upon reacting with a developing agent as a releasable group disclosed in U.S. Pat. No. 4,777,120.

Compounds which release photographically useful residual groups upon coupling can also preferably be used in the present invention. The preferred DIR couplers which release development inhibitors are disclosed in the patents cited in the foregoing *Research Disclosure*, No. 17643, item VII-F, ibid., No. 307105, item VII-F, JP-A-57-151944, JP-A-57-154234, JP-A-60-184248, JP-A-63-37346, JP-A-63-37350, U.S. Pat. Nos. 4,248,962 and 4,782,012.

Couplers disclosed in JP-A-59-157638, JP-A-59-170840, British Patents 2,097,140, and 2,131,188 are preferred as couplers which imagewise release nucleating agents or development accelerators at the time of development. Further, compounds which release fogging agents, development accelerators, silver halide solvents, etc., upon oxidation reduction reaction with the oxidation products of developing agents disclosed in JP-A-60-107029, JP-A-60-252340, JP-A-1-44940 and JP-A-1-45687 are also preferred.

Other compounds which can be used in the photographic material of the present invention include competitive couplers disclosed in U.S. Pat. No. 4,130,427, multiequivalent couplers disclosed in U.S. Pat. Nos. 4,283,472, 4,338,393 and 4,310,618, DIR redox compound-releasing couplers, DIR coupler-releasing couplers, DIR coupler-releasing redox compounds or DIR redox-releasing redox compounds disclosed in JP-A-60-185950 and JP-A-62-24252, couplers which release dyes which restore colors after separation disclosed in EP-A-173302 and EP-A-313308, bleaching accelerator-releasing couplers disclosed in the patents cited in *Research Disclosure*, No. 11449, ibid., No. 24241 and JP-A-61-201247, ligand-releasing couplers disclosed in U.S. Pat. No. 4,553,477, leuco dye-releasing couplers disclosed in JP-A-63-75747, and fluorescent dye-releasing couplers disclosed in U.S. Pat. No. 4,774,181.

Two or more of the above couplers, etc., can be used in combination in the same layer for satisfying the characteristics required of the photographic material, or, of course, the same compound can be added to two or more different layers.

The above couplers are contained in a silver halide photographic emulsion layer which constitutes a light-sensitive layer generally in an amount of from 0.1 to 1.0 mol, preferably from 0.1 to 0.5 mol, per mol of the silver halide.

In the present invention, various known methods can be used to incorporate the above couplers into a light-sensitive layer. In general, an oil-in-water dispersing method known as an oil-protect method is effectively used for the addition. That is, the coupler is dissolved in a solvent, then dispersed in an aqueous solution of gelatin containing a surfactant. Alternatively, couplers may be added as oil-in-water dispersion accompanied by phase inversion by adding water or an aqueous solution of gelatin to a coupler solution containing a surfactant. In addition, alkali-soluble couplers can be dispersed according to a so-called Fischer dispersing method. After a low boiling point organic solvent is removed from the coupler dispersion by distillation, noodle washing or ultrafiltration, couplers may be mixed with a photographic emulsion.

As a dispersion medium of couplers, it is preferred to use a high boiling point organic solvent having a dielectric constant of from 2 to 20 at 25° C. and a refractive index of from 1.5 to 1.7 at 25° C. and/or a water-insoluble high molecular compound. Such solvents as disclosed in the above JP-A-2-248945, p. 30 are preferably used as a high boiling point organic solvent. Compounds which have a melting point of 100° C. or less, a boiling point of 140° C. or more, immiscible with water, and a good solvent to couplers can be used. A melting point of a high boiling point organic solvent is preferably 80° C. or less and a boiling point is preferably 160° C. or more, more preferably 170° C. or more.

These high boiling point organic solvents are disclosed in detail in JP-A-62-215272, p. 137 right lower column to p. 144, right upper column.

These couplers can be dispersed in a hydrophilic colloidal aqueous solution in an emulsified state by impregnating with a loadable latex polymer (e.g., disclosed in U.S. Pat. No. 4,203,716) in the presence (or absence) of the above high boiling point organic solvents, or by dissolving in a polymer insoluble in water but soluble in an organic solvent. Homopolymers or copolymers disclosed in WO 88/00723, from pages 12 to 30 are preferably used as such polymers insoluble in water but soluble in an organic solvent, in particular, acrylamide based polymers are preferred in view of dye image stability.

The following compounds are particularly preferably used in combination with the above couplers.

That is, the use of a compound which produces a chemically inactive and substantially colorless compound upon chemically bonding with an aromatic amine developing agent remaining after color development and/or a compound which an aromatic amine color developing agent remaining after color development, alone or in combination, is preferred for preventing the generation of stain due to the formation of a colored dye caused by the coupling reaction of a coupler with the color developing agent or the oxidized product thereof remaining in the film, or preventing other side reactions, during preservation after processing. Such compounds and desired conditions are disclosed in detail in JP-A-2-248945, pp. 31 and 32, and as preferred specific examples of the former, compounds disclosed in JP-A-63-158545, JP-A-62-283338, Japanese Patent Application No. 62-158342 (JP-A-64-2042), European Patents 277589 and 298321 can be mentioned, and as those of the latter, compounds disclosed in JP-A-62-143048, JP-A-62-229145, European Patent 255722, Japanese Patent Application Nos. 62-158342 and 62-214681 (JP-A-1-57259), JP-A-1-230039, European Patents 277589 and 298321 can be cited. Further, combinations of the former and the latter are disclosed in European Patent 277589.

Silver halide emulsion layers and/or other hydrophilic colloid layers of a silver halide photographic material containing the emulsion according to the present invention may contain dyes for the purpose of increasing image sharpness and safelight safety or preventing color mixing. Such dyes may be added to the layer in which the emulsion is contained or not contained but are preferably fixed in a specific layer. For that sake, dyes are included in colloid layers in a nondiffusible state and used so as to be decolored during the course of development processing. In the first place, a fine grain dispersion of a dye which is substantially insoluble in water having pH 7 and soluble in water of pH 7 or more is used. Secondly, an acidic dye is used together with a polymer or a polymer latex having a cation site. Dyes represented by formulae (VI) and (VII) disclosed in JP-A-63-197947 are useful in the first and second methods, in particular, the dye having a carboxyl group is effective in the first method.

It is preferred for the photographic material of the present invention to contain phenethyl alcohol and various antiseptics or biocides, e.g., 1,2-benzisothiazolin-3-one, n-butyl-p-hydroxybenzoate, phenol, 4-chloro-3,5-dimethyl-phenol, 2-phenoxyethanol, 2-(4-thiazolyl)benzimidazole, etc., disclosed in JP-A-62-272248, JP-A-63-257747 and JP-A-1-80941.

There is no particular limitation on other additives for use in the photographic material of the present invention and, for example, disclosures in *Research Disclosure*, Vol. 176, Item 17643 (RD 17643), ibid., Vol. 187, Item 18716 (RD 18716) and ibid., Vol. 308, Item 308119 (RD 308119) can be referred to.

The locations related to various additives in RD 17643, RD 18716 and RD 308119 are indicated in the following table.

| Type of Additives | RD 17643 | RD 18716 | RD 308119 |
|---|---|---|---|
| 1. Chemical Sensitizers | page 23 | page 648, right column | page 996 |
| 2. Sensitivity Increasing Agents | — | page 648, right column | — |
| 3. Spectral Sensitizers and Supersensitizers | pages 23–24 | page 648, right column to page 649, right column | page 996, right column to page 998, right column |

-continued

| Type of Additives | RD 17643 | RD 18716 | |
|---|---|---|---|
| 4. Brightening Agents | page 24 | — | page 998, right column |
| 5. Antifoggants and Stabilizers | pages 24–25 | page 649, right column | page 998, right column to page 1000, right column<br>RD 307105 |
| 6. Light Absorbers, Filter Dyes, and Ultraviolet Absorbers | pages 25–26 | page 649, right column to page 650, left column | page 1003, left column to page 1003, right column |
| 7. Antistaining Agents | page 25, right column | page 650, left to right columns | page 1002, right column |
| 8. Dye image Stabilizers | page 25 | — | page 1002, right column |
| 9. Hardening Agents | page 26 | page 651, left column | page 1004, right column to page 1005, left column |
| 10. Binders | page 26 | page 651, left column | page 1003, left column to page 1004, right column |
| 11. Plasticizers and Lubricants | page 27 | page 650, right column | page 1006, left column to page 1006 right column |
| 12. Coating Aids and Surfactants | pages 26–27 | page 650, right column | page 1005, left column to page 1006, left column |
| 13. Antistatic Agents | page 27 | page 650, right column | page 1006, right column to page 1007, left column |
| 14. Matting Agents | — | — | page 1008, left column |

The photographic material of the present invention can be applied, for example, to black-and-white and color negative films for photographing (for general and cinematographic uses), color reversal films (for slide and cinematographic uses), black-and-white and color photographic papers, color positive films (for cinematographic use), color reversal photographic papers, black-and-white and color heat-developable photographic materials, black-and-white and color photographic materials for plate making (lith films and scanner films, etc.), black-and-white and color photographic materials for medical and industrial uses, black-and-white and color diffusion transfer photographic materials (DTR), etc., and particularly preferably used as color papers.

Proper supports which can be used in the present invention are disclosed, for example, in RD, No. 17643, p. 28, ibid., No. 18716, p. 647, right column to p. 648, left column, and ibid., No. 307105, p. 879.

In photographic processing of photographic materials using the present invention, any known method can be used and any known processing solution can be used. The processing temperature is selected generally between 18° C. and 50° C. but temperatures lower than 18° C. or higher than 50° C. are available. According to purposes, both development processing for forming a silver image (black-and-white photographic processing) and color photographic processing comprising development processing for forming a dye image can be applied.

In a black-and-white developing solution, known developing agents such as dihydroxybenzenes (e.g., hydroquinone), 3-pyrazolidones (e.g., 1-phenyl-3-pyrazolidone), aminophenols (e.g., N-methyl-p-aminophenol) and the like can be used alone or in combination.

A color developing solution, in general, comprises an alkaline aqueous solution containing a color developing agent.

As a color developing agent, conventionally known aromatic primary amine color developing agents can be used, for example, p-phenylenediamines (e.g., 4-amino-N-diethyl-aniline, 4-amino-3-methyl-N,N-diethylaniline, 4-amino-N-ethyl-N-β-hydroxyethylaniline, 4-amino-3-methyl-N-ethyl-N-β-hydroxyethylaniline, 4-amino-3-methyl-N-ethyl-N-β-methane-sulfonylaminoethylaniline, 4-amino-3-methyl-N-ethyl-N-β-methoxyethylaniline).

In addition to the above, those disclosed in L. F. A. Mason, *Photographic Processing Chemistry*, Focal Press, pp. 226 to 229 (1966), U.S. Pat. Nos. 2,193,015, 2,592,364, and JP-A-48-64933 may be used.

A developing solution can contain a pH buffer such as alkali metal sulfite, carbonate, borate and phosphate, or a development inhibitor or an antifoggant such as bromide, iodide, and an-organic antifoggant. A developing solution may also contain, if necessary, a water softener, a preservative such as hydroxylamine, an organic solvent such as benzyl alcohol and diethylene glycol, a development accelerator such as polyethylene glycol, quaternary ammonium salt, and amines, a dye-forming coupler, a competitive coupler, a fogging agent such as sodium boronhydride, an auxiliary developing agent such as 1-phenyl-3-pyrazolidone, a thickener, the polycarboxylic acid chelating agent disclosed in U.S. Pat. No. 4,083,723, or the antioxidant disclosed in West German Patent (OLS) No. 2,622,950.

When color photographic processing is conducted, a photographic material is generally bleaching processed after being color development processed. A bleaching process and a fixing process may be carried out at the same time or may be performed separately. Compounds of polyvalent metals such as iron(III), cobalt(III), chromium(IV), copper(II), etc., peracids, quinones, and nitro compounds are used as a bleaching agent. For example, bleaching agents which can be used include a complex salt such as an organic complex salt of ferricyanide, bichromate, iron(III) or cobalt(III) with aminopolycarboxylic acids, e.g., ethylenediaminetetraacetic acid, nitrilotriacetic acid, and 1,3-diamino-2-propanoltetraacetic acid, or citric acid, tartaric acid, malic acid, or persulfate, permanganate or nitrosophenol. The use of potassium ferricyanide, sodium ethylenediaminetetraacetic acid iron(III) complex salt and ammonium ethylenediaminetetraacetic acid iron(III) complex salt is preferred above all. Ethylenediaminetetraacetic acid iron(III) complex salt is useful in a bleaching solution or a monobath blixing solution.

A bleaching solution of a blixing solution can contain various additives as well as thiol compounds disclosed in U.S. Pat. Nos. 3,042,520, 3,241,966, JP-B-45-8506, and JP-B-45-8836. Further, the photographic material of the present invention may be subjected to washing process or may be processed with a stabilizing solution without employing a washing step after bleaching or blixing step.

The present invention is preferably applied to a silver halide photographic material having a transparent magnetic recording layer. The polyester laminar supports which have been previously heat-treated disclosed in detail in JP-A-6-35118, JP-A-6-17528, and Hatsumei-Kyokai Kokai Giho No. 94-6023, e.g., polyethylene aromatic dicarboxylate based polyester supports having a thickness of from 50 to 300 $\mu$m, preferably from 50 to 200 $\mu$m, more preferably from 80 to 115 $\mu$m, and particularly preferably from 85 to 105 $\mu$m, annealed at 40° C. or more and the glass transition point temperature or less for from 1 to 1,500 hours, are preferably used for silver halide photographic materials having a magnetic recording layer for use in the present invention. The above-described supports can be subjected to a surface treatment such as an ultraviolet irradiation treatment as disclosed in JP-B-43-2603, JP-B-43-2604 and JP-B-45-3828, a corona discharge treatment as disclosed in JP-B-48-5043 and JP-A-51-131576, and a glow discharge treatment as disclosed in JP-B-35-7578 and JP-B-46-43480, undercoated as disclosed in U.S. Pat. No. 5,326,689, provided with an underlayer as disclosed in U.S. Pat. No. 2,761,791, if necessary, and coated with ferromagnetic grains as disclosed in JP-A-59-23505, JP-A-4-195726 and JP-A-6-59357.

The above-described magnetic layer may be provided on a support in stripe as disclosed in JP-A-4-124642 and JP-A-4-124645.

Further, the supports are subjected to an antistatic treatment, if necessary, as disclosed in JP-A-4-62543, and finally silver halide photographic emulsion are coated. The silver halide emulsions disclosed in JP-A-4-166932, JP-A-3-41436 and JP-A-3-41437 are used herein.

The photographic material of the present invention is preferably manufactured according to the manufacturing and controlling methods as disclosed in JP-B-4-86817 and manufacturing data are recorded according to the methods disclosed in JP-B-6-87146. Before or after that, according to the methods disclosed in JP-A-4-125560, the photographic material is cut to a film of a narrower width than that of a conventional 135 size film and two perforations are made on one side per a smaller format picture plane so as to match with the smaller format picture plane than the picture plane heretofore in use.

The thus-produced film can be loaded and used in the cartridge packages disclosed in JP-A-4-157459, the cartridge disclosed in FIG. 9 in Example of JP-A-5-210202, the film patrones disclosed in U.S. Pat. No. 4,221,479, and the cartridges disclosed in U.S. Pat. Nos. 4,834,306, 4,834,366, 5,226,613 and 4,846,418.

Film cartridges and film patrones of the type which can encase a film tip as disclosed in U.S. Pat. Nos. 4,848,893 and 5,317,355 are preferred in view of the light shielding capability.

Further, a cartridge which has a locking mechanism as disclosed in U.S. Pat. No. 5,296,886, a cartridge which has the displaying function of working conditions, and a cartridge which has the function of preventing double exposure as disclosed in U.S. Pat. No. 5,347,334 are preferred.

In addition, a cartridge by which a film can be easily loaded only by inserting a film into a cartridge as disclosed in JP-A-6-85128 may be used.

The thus-produced film cartridges can be used for various photographic pleasures such as photographing and development processing using the following cameras, developing machines, and laboratory devices according to purposes.

The functions of film cartridges (patrones) can be sufficiently demonstrated using, for example, the easily loadable camera disclosed in JP-A-6-8886 and JP-A-6-99908, the automatic winding type camera disclosed in JP-A-6-57398 and JP-A-6-101135, the camera capable of pulling out the film and exchanging for a different kind of film in the course of photographing disclosed in JP-A-6-205690, the camera which can magnetically record the information at photographing time such as panorama photographing, high vision photographing or general photographing (capable of magnetic recording which can set up the print aspect ratio) disclosed in JP-A-5-293138 and JP-A-5-283382, the camera having the function of preventing double exposure disclosed in JP-A-6-101194, and the camera having the displaying function of working conditions of a film and the like disclosed in JP-A-5-150577.

The thus-photographed films may be processed using the automatic processors disclosed in JP-A-6-222514 and JP-A-6-212545, the using methods of the magnetic recording information on the film disclosed in JP-A-6-95265 and JP-A-4-123054 may be used before, during or after processing, or the function of selecting the aspect ratio disclosed in JP-A-5-19364 can be used.

If development processing is motion picture type development, the film is processed by splicing according to the method disclosed in JP-A-5-119461.

Further, during and after development processing, the attachment and detachment disclosed in JP-A-6-148805 are conducted.

After processing has been conducted thus, the information on the film may be altered to a print through back printing and front printing according to the methods disclosed in JP-A-2-184835, JP-A-4-186335 and JP-A-6-79968.

The film may be returned to a customer with the index print disclosed in JP-A-5-11353 and J-P-A-5-232594 and the return cartridge.

The evaluation of the adsorption amount of a sensitizing dye onto emulsion grains was conducted using the following two methods in combination, that is, one method in which the adsorbed dye amount was obtained by centrifuging the emulsion on which a dye was adsorbed to separate into emulsion grains and a supernatant aqueous gelatin solution, and subtracting the dye density not adsorbed, which was obtained from the spectral absorption measurement of the supernatant, from the addition amount of the dye, another method in which the adsorbed dye amount was obtained by drying precipitated emulsion grains, dissolving a certain weight of precipitate in a mixed solution of an aqueous solution of sodium thiosulfate and methanol in a ratio of 1/1, and conducting spectral absorption measurement. With respect to the method of obtaining the adsorption amount of a dye by measuring the dye amount in a supernatant, W. West, et al., *Journal of Physical Chemistry*, Vol. 56, p. 1054 (1952) can be referred to. When a dye was added in quantities, the dye not adsorbed sometimes precipitated, therefore, in some cases, the exact adsorbed dye amount could not necessarily be obtained by the method of measuring the dye density in a supernatant. On the other hand, it was found that according to the method of dissolving the precipitated silver halide grains and measuring the adsorption amount of a dye, as the precipitating rate of emulsion grains was overwhelmingly rapid, grains and precipitated dye could be easily separated and the dye amount adsorbed onto the grains could be exactly measured.

The light absorption strength per unit area of a grain surface can be obtained using a microspectrophotometer. A microspectrophotometer is a device which can measure the absorption spectrum of a minute area and the transmission spectrum of one grain can be measured. With respect to the measurement of the absorption spectrum of one grain by a microspectral method, Yamashita, et al., *A Summary of Lectures of Annual Meeting of Nihon Shashin Gakkai*, 1996, p. 15 can be referred to. The light absorption strength per one grain can be found from this absorption spectrum, but as the light transmitted through a grain is absorbed at two faces of upper and lower faces, the light absorption strength per unit area of a grain surface can be searched for as one half of the light absorption strength per one grain obtained by the above method.

The present invention is described in detail below with reference to the specific examples, but the present invention should not be construed as being limited thereto.

EXAMPLE 1

Preparation of Pure Silver Bromide Tabular Grain Emulsion and Silver Iodobromide Tabular Grain Emulsion Six point four (6.4) g of potassium bromide and 6.2 g of low molecular weight gelatin having an average molecular weight of 15,000 or less were dissolved in 1.2 liters of water, and 8.1 ml of a 16.4% aqueous solution of silver nitrate and 7.2 ml of a 23.5% aqueous solution of potassium bromide were added thereto by a double jet method over 10 seconds while maintaining the temperature at 30° C. Subsequently, a 11.7% aqueous solution of gelatin was further added thereto with increasing the temperature to 75° C., and physical ripening was carried out for 40 minutes. Then, 370 ml of a 32.2% aqueous solution of silver nitrate and a 20% aqueous solution of potassium bromide were added over 10 minutes while maintaining silver potential at −20 mV. After physical ripening was carried out over 1 minute, the temperature was lowered to 35° C. Thus a monodisperse pure silver bromide tabular grain emulsion (specific gravity:1.15) having an average projected area diameter of 2.32 μm, a thickness of 0.09 μm and a variation coefficient of a diameter of 15.1% was obtained.

After soluble salts were removed by flocculation, the temperature was again raised to 40° C., and 45.6 g of gelatin, 10 ml of an aqueous solution of sodium hydroxide having a concentration of 1 mol/liter, 167 ml of water and 10 ml of 5% phenol were added, and pAg and pH were adjusted to 6.88 and 6.16, respectively, to obtain Emulsion A.

Emulsion B was prepared by replacing a 20% aqueous solution of potassium bromide at tabular grain growth with a mixed aqueous solution of 17% potassium bromide and 3% potassium iodide in the preparation of Emulsion A.

Emulsions A and B were ripened at 55° C. for 50 minutes with potassium thiocyanate, chloroauric acid and sodium thiosulfate to have optimal sensitivity.

While maintaining each of the thus-obtained emulsions at 50° C., the first dye shown in Table 1 below was added to each emulsion and stirred at 50° C. for 30 minutes, then, the second dye was added and stirring was conducted for another 30 minutes at 50° C.

TABLE 1

| | | First Dye | | Second Dye | |
|---|---|---|---|---|---|
| | Emulsion | Kind of Dye | Addition amount ($10^{-3}$ mol/mol-Ag) | Kind of Dye | Addition amount ($10^{-3}$ mol/mol-Ag) |
| Comparison 1 | A | H-1 | 6.60 | None | — |
| Comparison 2 | A | H-1 | 3.60 | H-2 | 3.00 |
| Comparison 3 | A | None | — | H-2 | 6.60 |
| Invention 1 | A | H-1 | 3.60 | S-51 | 3.00 |
| Invention 2 | A | S-6 | 3.60 | S-51 | 3.00 |
| Invention 3 | A | S-1 | 3.60 | H-2 | 3.00 |
| Invention 4 | A | S-1 | 3.60 | S-51 | 3.00 |
| Invention 5 | B | S-1 | 3.60 | S-51 | 3.00 |

H-1

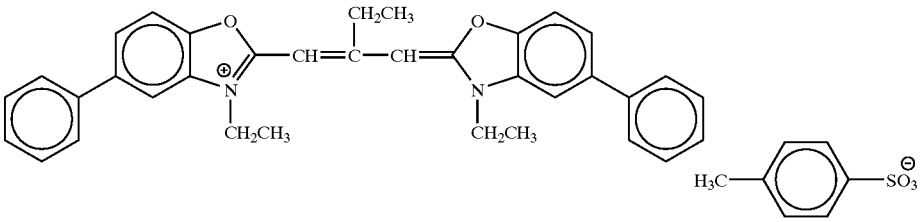

H-2

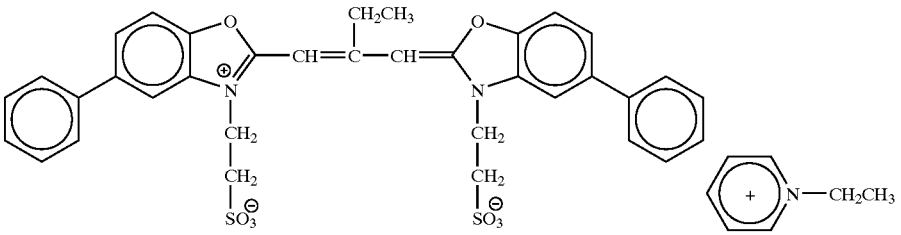

The obtained liquid emulsion was precipitated by centrifuging at 10,000 rpm for 10 minutes, the precipitate was freeze-dried, 25 ml of a 25% aqueous solution of sodium thiosulfate and methanol were added to 0.05 g of the precipitate and the dye adsorption amount was made 50 ml. This solution was analyzed by high performance liquid chromatography and the dye density was determined.

The measurement of the light absorption strength per unit area was conducted as follows: that is, the obtained emulsion was coated thinly on a slide glass and transmission spectrum and reflection spectrum of each grain was measured using a microspectrophotometer MSP 65 produced by Carl Zeiss according to the following method, from which absorption spectrum was searched for. A portion where grains were not present was taken as a reference of transmission spectrum and silicon carbide the reflectance of which was known was measured and the obtained value was made a reference of reflection spectrum. The measuring part was a circular aperture of a diameter of 1 $\mu$m, and transmission spectrum and reflection spectrum were measured in the wave number range of from 14,000 $cm^{-1}$ (714 nm) to 28,000 $cm^{-1}$ (357 nm) by adjusting the position such that the aperture part was not overlapped with the contour of the grain. Absorption spectrum was found according to 1−T (transmittance)−R (reflectance) as absorption factor A, one from which the absorption by silver halide was deducted was taken as absorption A'. The value obtained by integrating −Log (1−A') to wave number ($cm^{-1}$) was divided by 2 and this value was made the light absorption strength per unit surface area. The integrated range was from 14,000 $cm^{-1}$ to 28,000 $cm^{-1}$. A tungsten lamp was used as a light source and the light source voltage was 8 V. For minimizing the injury of a dye by irradiation of light, a primary monochromator was used, the distance of wavelength was 2 nm, and a slit width was 2.5 nm.

A gelatin hardening agent and a coating aid were added to the emulsion obtained, which was coated in a coating silver amount of 3.0 g-Ag/$m^2$ on a cellulose triacetate film support with a gelatin protective layer by a double extrusion method. The obtained film was exposed with a tungsten lamp (color temperature: 2,854° K.) for 1 second through a continuous wedge color filter. As a color filter, UVD33S filter was combined with V40 filter (a product of Toshiba Co., Ltd.) for blue exposure for exciting silver halide and the sample was irradiated with light of wavelength range of 330 nm to 400 nm. Fuji gelatin filter SC-52 (a product of Fuji Photo Film Co., Ltd.) was used for minus blue exposure for exciting the dye side and the sample was irradiated with the light of 520 nm or less being cut off. The exposed sample was development processed at 20° C. for 10 minutes with the following surface developing solution MAA-1.

| Surface Developing Solution MAA-1 | |
|---|---|
| Metol | 2.5 g |
| L-Ascorbic acid | 10 g |
| Nabox (a product of Fuji Photo Film Co., Ltd.) | 35 g |
| Potassium Bromide | 1 g |
| Water to make | 1 liter |
| pH | 9.8 |

Optical density of the development processed film was measured using a Fuji automatic densitometer. Sensitivity was a reciprocal of exposure amount required to give an optical density of fog +0.2 and expressed as a relative value taking Comparison 1 as a control, with fog being the density at the unexposed part.

The results obtained are shown in Tables 2 and 3 below. As is shown in Table 2, using the dye addition method according to the present invention, multilayer adsorption onto the grain surface became feasible and the light absorption strength per unit area of a grain surface (½ of the light absorption strength of one grain) was conspicuously increased. Further, as a result, as shown in Table 3, color sensitization sensitivity was drastically increased.

TABLE 2

| | Light | First Dye | | | Second Dye | | |
|---|---|---|---|---|---|---|---|
| | Absorption Strength per Unit Surface Area | Kind of Dye | Adsorption Amount ($10^{-3}$ mol/mol-Ag) | Coating Rate (%) | Kind of Dye | Adsorption Amount ($10^{-3}$ mol/mol-Ag) | Coating Rate (%) |
| Comparison 1 | 83 | H-1 | 1.47 | 98 | None | — | — |
| Comparison 2 | 82 | H-1 | 1.28 | 85 | H-2 | 0.17 | 11 |
| Comparison 3 | 76 | None | — | — | H-2 | 1.41 | 94 |
| Invention 1 | 135 | H-1 | 1.37 | 91 | S-51 | 1.08 | 72 |
| Invention 2 | 183 | S-6 | 2.13 | 142 | S-51 | 1.47 | 98 |
| Invention 3 | 155 | S-1 | 2.10 | 140 | H-2 | 0.71 | 47 |
| Invention 4 | 306 | S-1 | 3.12 | 208 | S-51 | 2.31 | 154 |
| Invention 5 | 336 | S-1 | 3.39 | 226 | S-51 | 2.47 | 165 |

TABLE 3

| | Blue Sensitivity | Minus Blue Sensitivity | Color Sensitization Sensitivity (minus blue sensitivity/ blue sensitivity) |
|---|---|---|---|
| Comparison 1 | 100 | 100 | 100 |
| Comparison 2 | 97 | 99 | 102 |
| Comparison 3 | 95 | 96 | 101 |
| Invention 1 | 99 | 148 | 149 |
| Invention 2 | 96 | 171 | 178 |
| Invention 3 | 93 | 143 | 154 |
| Invention 4 | 93 | 211 | 227 |
| Invention 5 | 96 | 230 | 240 |

EXAMPLE 2

Preparation of Silver Iodobromide Cubic Emulsion

One thousand (1,000) ml of water, 25 g of deionized ossein gelatin, 15 ml of a 50% aqueous solution of $NH_4NO_3$, and 7.5 ml of a 25% aqueous solution of $NH_3$ were put in a reaction vessel and stirred thoroughly, while maintaining the temperature at 50° C., then 750 ml of an aqueous solution of 1N silver nitrate and an aqueous solution containing 1 mol/liter of potassium bromide and 0.05 mol/liter of potassium iodide were added over 50 minutes with maintaining the silver potential during reaction of +50 mV to a saturated calomel electrode.

The thus-obtained silver iodobromide grains were cubic having a side length of 0.78±0.06 $\mu$m. The temperature of the above emulsion was lowered, a copolymer of isobutene and monosodium maleate was added thereto as a coagulant, the precipitate was washed with water and desalted. In the next place, 95 g of deionized ossein gelatin and 430 ml of water were added and pH and pAg were adjusted to 6.5 and 8.3, respectively, at 50° C. Subsequently, sodium thiosulfate was added and ripening was carried out over 50 minutes at 55° C. to obtain optimal sensitivity. One (1) kg of this emulsion contained 0.74 mol of silver bromide. This emulsion was designated Emulsion C.

Emulsion C was weighed each in 50 g portion and, with maintaining the temperature at 50° C., the mixture of the first dyes shown in Table 4 below was added to each emulsion and stirred at 60° C. for 10 minutes, then, the mixture of the second dyes was added and stirred for further 30 minutes at 60° C., thereafter each emulsion was coated as described below.

The coating amount of silver was 2.5 g/m$^2$, and the coating amount of gelatin was 3.8 g/m$^2$. An aqueous solution comprising as main components 0.22 g/liter of sodium dodecylbenzenesulfonate, 0.50 g/liter of sodium p-sulfostyrene homopolymer, 3.1 g/liter of sodium 2,4-chloro-6-hydroxy-1,3,5-triazine, and 50 g/liter of gelatin was coated as an upper layer by a double extrusion method such that the coating amount of gelatin became 1.0 g/m$^2$.

Measurement of the dye adsorption amount, exposure and development were conducted in the same manner as in Example 1. Optical density of the development processed film was measured using a Fuji automatic densitometer. Sensitivity was a reciprocal of exposure amount required to give an optical density of fog+0.2 and expressed as a relative value taking Comparison 1 as a control, with fog being the density at the unexposed part.

TABLE 4

| | First Dye | | Second Dye | |
|---|---|---|---|---|
| | Kind of Dye and Addition Amount ($10^{-3}$ mol/mol-Ag) | Kind of Dye and Addition Amount ($10^{-3}$ mol/mol-Ag) | Kind of Dye and Addition Amount ($10^{-3}$ mol/mol-Ag) | Kind of Dye and Addition Amount ($10^{-3}$ mol/mol-Ag) |
| Comparison 1 | H-3 (1.60) | — | — | — |
| Comparison 2 | H-4 (1.60) | — | — | — |
| Invention 1 | H-4 (0.35) | S-18 (0.60) | H-5 (0.15) | S-56 (0.50) |
| Invention 2 | — | S-18 (0.95) | H-5 (0.15) | S-56 (0.50) |
| Invention 3 | H-4 (0.35) | S-18 (0.60) | — | S-56 (0.65) |

H-3

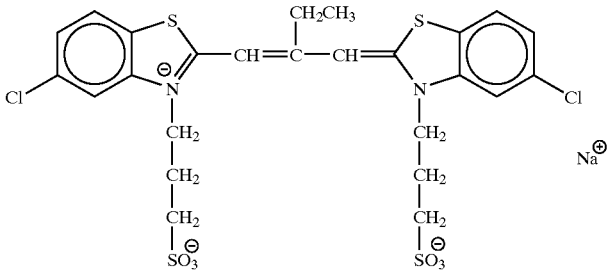

TABLE 4-continued

| | First Dye | | Second Dye | |
|---|---|---|---|---|
| | Kind of Dye and Addition Amount ($10^{-3}$ mol/mol-Ag) | Kind of Dye and Addition Amount ($10^{-3}$ mol/mol-Ag) | Kind of Dye and Addition Amount ($10^{-3}$ mol/mol-Ag) | Kind of Dye and Addition Amount ($10^{-3}$ mol/mol-Ag) |

H-4

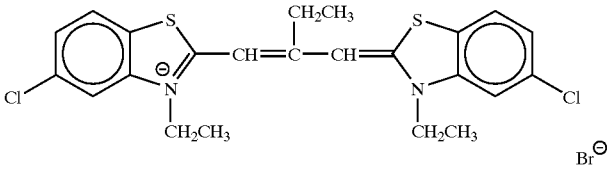

H-5

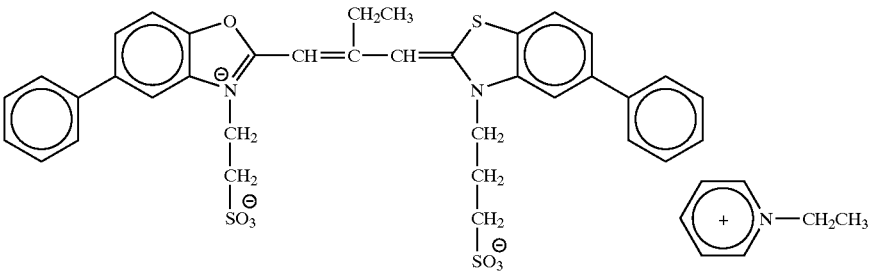

The results obtained are shown in Tables 5 and 6. As is shown in Table 5, using the dye addition method according to the present invention, multilayer adsorption onto the grain surface became feasible. As is shown in Table 6, color sensitization sensitivity was drastically increased.

TABLE 5

| | First Dye | | | Second Dye | | |
|---|---|---|---|---|---|---|
| | Kind of Dye and Adsorption Amount ($10^{-3}$ mol/mol-Ag) | Kind of Dye and Adsorption Amount ($10^{-3}$ mol/mol-Ag) | Total Coating Rate (%) | Kind of Dye and Adsorption Amount ($10^{-3}$ mol/mol-Ag) | Kind of Dye and Adsorption Amount ($10^{-3}$ mol/mol-Ag) | Total Coating Rate (%) |
| Comparison 1 | H-3 (0.62) | — | 95 | — | — | — |
| Comparison 2 | H-4 (0.59) | — | 90 | — | — | — |
| Invention 1 | H-4 (0.17) | S-18 (0.58) | 130 | H-5 (0.07) | S-56 (0.35) | 65 |
| Invention 2 | — | S-18 (0.91) | 140 | H-5 (0.05) | S-56 (0.47) | 80 |
| Invention 3 | H-4 (0.21) | S-18 (0.59) | 129 | — | S-56 (0.62) | 95 |

TABLE 6

| | Blue Sensitivity | Minus Blue Sensitivity | Color Sensitization Sensitivity (minus blue sensitivity/ blue sensitivity) |
|---|---|---|---|
| Comparison 1 | 100 | 100 | 100 |
| Comparison 2 | 99 | 99 | 100 |
| Invention 1 | 97 | 139 | 143 |

TABLE 6-continued

| | Blue Sensitivity | Minus Blue Sensitivity | Color Sensitization Sensitivity (minus blue sensitivity/ blue sensitivity) |
|---|---|---|---|
| Invention 2 | 95 | 168 | 177 |
| Invention 3 | 94 | 203 | 216 |

EXAMPLE 3

Zero point five (0.5) liters of water was added to 500 g of Emulsion B with maintaining the temperature at 40° C., then the first dye shown in Table 7 was added in the amount indicated as Addition A in Table 7 and stirred for 10 minutes at 40° C. The temperature was thereafter raised to 55° C., 7.8 ml of an aqueous solution containing 0.1M of potassium thiocyanate, 3 ml of 0.01% chloroauric acid, 6.6 ml of 0.01% sodium thiosulfate and 5.3 ml of M/10,000 (diphenyl)-(pentafluorophenyl)-phosphineselenide were added and ripening was conducted at 55° C. for 30 minutes. Subsequently, the first dye was added in the amount indicated as Addition B in Table 7 and stirred at 55° C. for 30 minutes, then 0.6 liters of the second dye in concentration of 1/500 mol/liter was added thereto and stirred at 55° C. for 30 minutes.

The dye adsorption amount of the obtained emulsion and the light absorption strength per unit surface area of emulsion grains were found in the same manner as in Example 1.

Exposure and development were also conducted in the same manner as in Example 1. Optical density of the development processed film was measured using a Fuji automatic densitometer. Sensitivity was a reciprocal of exposure amount required to give an optical density of fog+0.2 and expressed as a relative value taking Comparison 1 as a control, with fog being the density at the unexposed part.

TABLE 7

| | First Dye | | | Second Dye | |
|---|---|---|---|---|---|
| | Kind of Dye | Addition A ($10^{-3}$ mol/mol-Ag) | Addition B ($10^{-3}$ mol/mol-Ag) | Kind of Dye | Addition Amount ($10^{-3}$ mol/mol-Ag) |
| Comparison 1 | H-6 | 1.45 | 4.5 | H-7 | 3.2 |
| Comparison 2 | S-26 | 1.45 | 4.5 | — | — |
| Invention 1 | S-26 | 1.45 | 4.5 | H-7 | 3.2 |
| Invention 2 | S-26 | 5.95 | — | S-53 | 3.2 |
| Invention 3 | S-26 | 1.45 | 4.5 | S-53 | 3.2 |

H-6

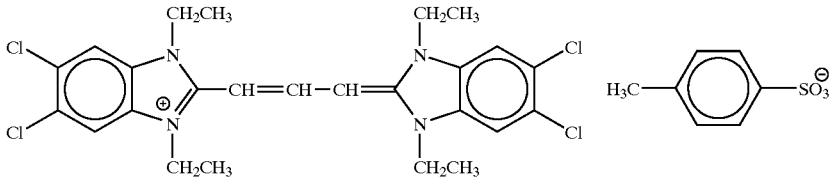

H-7

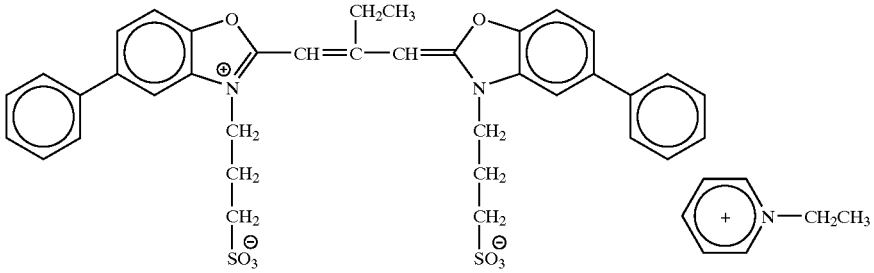

The dye adsorption amount and the light absorption strength per unit surface area are shown in Table 8 and sensitivity in Table 9 below. Thus, the adsorption amount of sensitizing dyes could be increased using the dye addition method according to the present invention, and the light absorption strength per unit surface area could also be improved. Further, as chemical sensitization was conducted when the optimal amount of a dye was added, the site of a chemical sensitization speck was limited and intrinsic sensitivity could also be increased. The sensitivity due to the improvement of light absorption factor could be largely increased.

TABLE 8

| | Light | First Dye | | Second Dye | |
|---|---|---|---|---|---|
| | Absorption Strength per Unit Surface Area | Adsorption Amount ($10^{-3}$ mol/mol-Ag) | Coating Rate (%) | Adsorption Amount ($10^{-3}$ mol/mol-Ag) | Coating Rate (%) |
| Comparison 1 | 89 | 1.41 | 94 | 0.03 | 2 |
| Comparison 2 | 92 | 1.47 | 98 | — | — |
| Invention 1 | 182 | 2.32 | 155 | 0.74 | 49 |
| Invention 2 | 489 | 5.33 | 355 | 2.91 | 194 |
| Invention 3 | 490 | 5.33 | 355 | 2.88 | 192 |

TABLE 9

| | Blue Sensitivity | Minus Blue Sensitivity | Color Sensitization Sensitivity (minus blue sensitivity/ blue sensitivity) |
|---|---|---|---|
| Comparison 1 | 100 | 100 | 100 |
| Comparison 2 | 101 | 100 | 99 |
| Invention 1 | 95 | 188 | 179 |
| Invention 2 | 91 | 308 | 338 |
| Invention 3 | 101 | 343 | 340 |

EXAMPLE 4

Tabular silver iodobromide emulsion was prepared in the same manner as the preparation of Emulsion D in Example 5 of JP-A-8-29904 and this emulsion was designated Emulsion 4A.

Multilayer color photographic materials were prepared in the same method as the preparation of Sample No. 101 in Example 5 of JP-A-8-29904. Emulsion D in the fifth layer of Sample No. 101 in Example 5 of JP-A-8-29904 was replaced with Emulsion 4A, H-4 was added in an amount of $1.1\times10^{-3}$ mol/mol-Ag, then H-8 was added in an amount of $1.0\times10^{-3}$ mol/mol-Ag, in place of ExS-1, -2 and -3, the thus-obtained sample was designated Sample No. 401, or S-20 was added in an amount of $1.1\times10^{-3}$ mol/mol-Ag, then S-58 was added in an amount of $1.0\times10^{-3}$ mol/mol-Ag, which was designated Sample No. 402.

For examining the sensitivity of the thus-obtained samples, samples were exposed for 1/100 second through an optical wedge and a red filter using Fuji FW type sensitometer (a product of Fuji Photo Film Co., Ltd.), color development processing was carried out using the same processing step and processing solutions in Example 1 of JP-A-8-29904 and cyan density was measured. The results obtained are shown in Table 10 below. Sensitivity was a reciprocal of exposure amount required to give a density of fog density+0.2 and expressed as a relative value taking Sample No. 401 as a control.

TABLE 10

| Sample No. | Sensitivity (fog + 0.2) |
|---|---|
| 401 | 100 (control) |
| 402 | 231 |

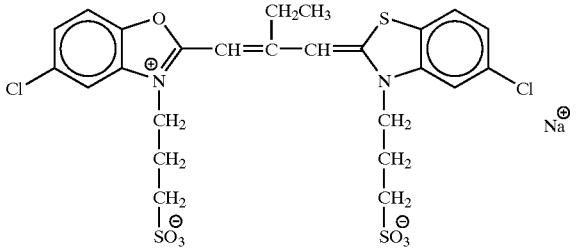

It was found that the sensitivity of a negative type multilayer color photographic material was also improved due to the increase of the dye adsorption amount by the addition method of a dye according to the present invention.

EXAMPLE 5

In Emulsion 1 in Example 1 of JP-A-7-92601, H-9 was added in an amount of $3.25\times10^{-3}$ mol/mol-Ag, then H-10 was added in an amount of $3.0\times10^{-3}$ mol/mol-Ag, in place of spectral sensitizing dyes S-4 and S-5, the thus-obtained emulsion was designated Emulsion 5A, or S-3 was added in an amount of $3.25\times10^{-3}$ mol/mol-Ag, then S-41 was added in an amount of $3.0\times10^{-3}$ mol/mol-Ag, this emulsion was designated Emulsion 5B. Further, in Emulsion 1 in Example 1 of JP-A-7-92601, the silver potential during the second double jet was changed from +65 mV to +115 mV, further, H-9 was added in an amount of $3.25\times10^{-3}$ mol/mol-Ag, then H-10 was added in an amount of $3.0\times10^{-3}$ mol/mol-Ag, in place of spectral sensitizing dyes S-4 and S-5, the thus-obtained emulsion was designated Emulsion 5C, or S-3 was added in an amount of $3.25\times10^{-3}$ mol/mol-Ag, then S-41 was added in an amount of $3.0\times10^{-3}$ mol/mol-Ag, this emulsion was designated Emulsion 5D.

Multilayer color photographic materials were prepared in the same method as the preparation of Sample No. 401 in Example 4 of JP-A-7-92601. Emulsion 1 in the ninth layer of Sample No. 401 in Example 4 of JP-A-7-92601 was replaced with Emulsion 5A or 5B, the thus-obtained sample was designated Sample No. 501 and 502. Similarly, Emulsion 1 in the ninth layer of Sample No. 401 in Example 4 of JP-A-7-92601 was replaced with Emulsion 5C or 5D, and these samples were designated Sample No. 503 and Sample No. 504.

The sensitivity of the thus-obtained samples was evaluated. In the same manner as in Example 4 of JP-A-7-92601, samples were subjected to exposure for 1/50 seconds and reversal development processing and magenta density was measured. The results obtained are shown in Table 11 below. Sensitivity was a reciprocal of exposure amount required to give a density of a minimum density+0.2 and which was obtained with sufficient exposure expressed as a relative value taking the sensitivity of Sample No. 501 as 100.

TABLE 11

| Sample No. | Sensitivity (Dmin + 0.2) |
|---|---|
| 501 | 100 (control) |
| 502 | 218 |
| 503 | 95 |
| 504 | 226 |

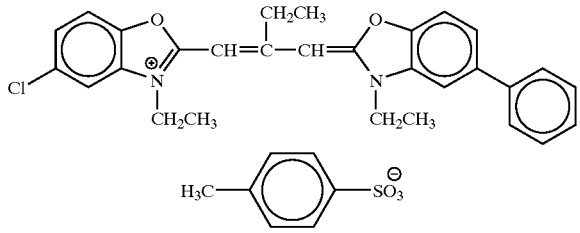

-continued

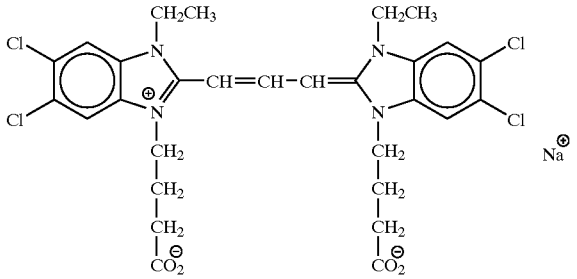

It was found that the sensitivity of a reversal multilayer color photographic material was also improved due to the increase of the dye adsorption amount by the addition method of a dye according to the present invention.

EXAMPLE 6

Octahedral silver bromide internal latent image type direct positive emulsion and hexagonal tabular silver bromide internal latent image type direct positive emulsion were prepared in the same manner as the preparation of Emulsions 1 and 5 in Example 1 of JP-A-5-313297 and these emulsions were named Emulsion 6A and Emulsion 6B.

Color diffusion transfer photographic films were prepared in the same manner as the preparation of Sample No. 101 in Example 1 of JP-A-5-313297. Emulsion-2 in the sixteenth layer of Sample No. 101 in Example 1 of JP-A-5-313297 was replaced with Emulsion 6A, H-11 was added in an amount of $4.5\times10^{-3}$ mol/mol-Ag, then H-12 was added in an amount of $4.0\times10^{-3}$ mol/mol-Ag, in place of sensitizing dye (3), the thus-obtained sample was designated Sample No. 601, or S-14 was added in an amount of $4.5\times10^{-3}$ mol/mol-Ag, then S-46 was added in an amount of $4.0\times10^{-3}$ mol/mol-Ag, this sample was designated Sample No. 602. Similarly, Emulsion-2 in the sixteenth layer of Sample No. 101 in the same example was replaced with Emulsion 6B, H-11 was added in an amount of $4.5\times10^{-3}$ mol/mol-Ag, then H-12 was added in an amount of $4.0\times10^{-3}$ mol/mol-Ag, in place of sensitizing dye (3), the thus-obtained sample was designated Sample No. 603, or S-14 was added in an amount of $4.5\times10^{-3}$ mol/mol-Ag, then S-46 was added in an amount of $4.0\times10^{-3}$ mol/mol-Ag, this sample was designated Sample No. 604.

For examining the sensitivity of the thus-obtained samples, processing was carried out using the same exposure, processing step and processing solutions as in Example 1 of JP-A-5-313297 and transfer density was measured using a color densitometer.

The results obtained are shown in Table 12 below. Sensitivity was a reciprocal of exposure amount required to give density of 1.0 and expressed as a relative value taking Sample No. 601 as a control.

TABLE 12

| Sample No. | Sensitivity (density 1.0) |
|---|---|
| 601 | 100 (control) |
| 602 | 205 |
| 603 | 120 |
| 604 | 245 |

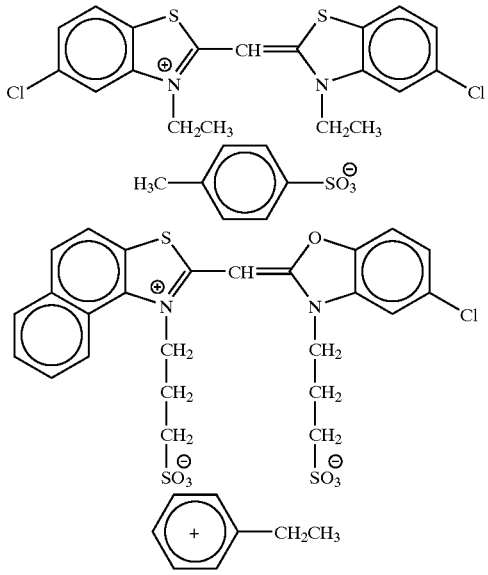

It was found that the sensitivity of a color diffusion transfer photographic film was also improved due to the increase of the dye adsorption amount by the addition method of a dye according to the present invention.

EXAMPLE 7

In the preparation of Emulsion F in Example 2 of JP-A-4-142536, a red-sensitive sensitizing dye (S-1) was not added before sulfur sensitization, in addition to sulfur sensitization using triethylthiourea, chloroauric acid was used in combination and optimally gold-sulfur sensitized, and after gold-sulfur sensitization, H-13 was added in an amount of $3.5\times10^{-4}$ mol/mol-Ag, then H-14 was added in an amount of $3.5\times10^{-4}$ mol/mol-Ag, the thus-obtained emulsion was designated Emulsion 7A, or S-50 was added in an amount of $3.5\times10^{-4}$ mol/mol-Ag, then S-16 was added in an amount of $3.5\times10^{-4}$ mol/mol-Ag, this emulsion was designated Emulsion 7B.

Multilayer color photographic papers were prepared in the same manner as the preparation of Sample No. 20 in Example 1 of JP-A-6-347944. The emulsion in the first layer of Sample No. 20 in Example 1 of JP-A-6-347944 was replaced with Emulsion 7A or 7B, these samples were designated Sample No. 701 and Sample No. 702.

For examining the sensitivity of the thus-obtained samples, samples were exposed for 1/10 second through an optical wedge and a blue filter using Fuji FW type sensitometer (a product of Fuji Photo Film Co., Ltd.), color development processing was carried out using the same processing step and processing solutions in Example 1 of JP-A-6-347944 and yellow density was measured. The results obtained are shown in Table 13 below. Sensitivity was a reciprocal of exposure amount required to give a density of fog+0.1 and expressed as a relative value taking Sample No. 701 as a control.

TABLE 13

| Sample No. | Sensitivity (fog + 0.2) |
|---|---|
| 701 | 100 (control) |
| 702 | 257 |

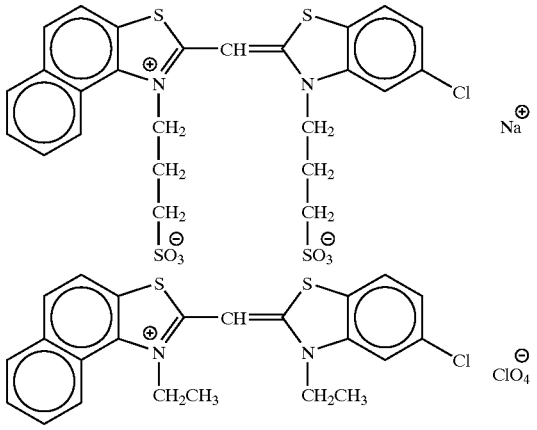

It was found that the sensitivity of a multilayer color photographic paper was also improved due to the increase of the dye adsorption amount by the addition method of a dye according to the present invention.

EXAMPLE 8

Tabular silver chloride emulsions were prepared in the same manner as the preparation of Emulsion A in Example 1 of Japanese Patent Application No. 7-232036. In chemical sensitization (B) in Example 1 of the same patent, in place of sensitizing dye-1 and -2, H-1 was added in an amount of $1.0\times10^{-3}$ mol/mol-Ag, gold-sulfur sensitization was conducted, then H-1 was added in an amount of $1.5\times10^{-3}$ mol/mol-Ag, subsequently, H-2 was added in an amount of $2.2\times10^{-3}$ mol/mol-Ag and H-15 was added in an amount of $3.8\times10^{-3}$ mol/mol-Ag, the thus-obtained emulsion was designated Emulsion 8A, or S-5 was added in an amount of $1.0\times10^{-3}$ mol/mol-Ag, then gold-sulfur sensitization was conducted, further, S-5 was added in an amount of $1.5\times10^{-3}$ mol/mol-Ag, thereafter S-65 was added in an amount of $2.2\times10^{-3}$ mol/mol-Ag and S-40 was added in an amount of $3.8\times10^{-5}$ mol/mol-Ag, the thus-obtained emulsion was designated Emulsion 8B.

Coated samples were prepared by replacing the emulsion in Example 1 of Japanese Patent Application No. 7-232036 with Emulsion 8A or Emulsion 8B and an emulsion layer and a surface protective layer were coated on both sides of a support by a double extrusion method as in Example 1, these samples were designated Sample Nos. 801 and 802. The coated silver amount per one side was 1.75 g/m$^2$.

For examining the sensitivity of the thus-obtained samples, samples were exposed for 0.05 second from both sides through an X-ray ortho-screen HGM produced by Fuji Photo Film Co., Ltd. and processed with the same automatic processor and processing solutions as in Example 1 of JP-7-232036. The results obtained are shown in Table 14 below. Sensitivity was a reciprocal of exposure amount required to give a density of fog+0.1 and expressed as a relative value taking Sample No. 801 as a control.

TABLE 14

| Sample No. | Sensitivity (fog + 0.2) |
|---|---|
| 801 | 100 (control) |
| 802 | 305 |

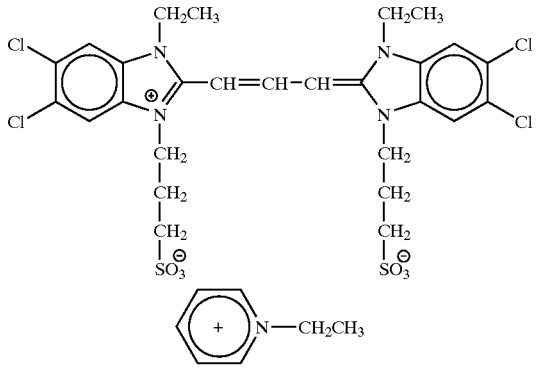

It was found that the sensitivity of an X-ray photographic material was also improved due to the increase of the dye adsorption amount by the addition method of a dye according to the present invention.

The same results were obtained when exposure was conducted using HR-4 or HGH instead of X-ray ortho-screen HGM which was used at exposure.

EXAMPLE 9

Tabular silver chloride emulsion was prepared in the same manner as the preparation of Emulsion D in Example 2 of Japanese Patent Application No. 7-146891 except that sensitizing dyes-2 and -3 were not added. This emulsion was designated Emulsion 9A. Coated samples were prepared in the same manner as the preparation of Coated Sample No. F in Example 3 of Japanese Patent Application No. 7-146891. A sample in which Emulsion F in Coated Sample No. F in Example 3 of Japanese Patent Application No. 7-146891 was replaced with Emulsion 9A, and H-1 was added in an amount of $3.0\times10^{-3}$ mol/mol-Ag, then H-2 was added in an amount of $2.0\times10^{-3}$ mol/mol-Ag in place of using sensitizing dye-1 was named Sample No. 901, and S-2 was added in an amount of $3.0\times10^{-3}$ mol/mol-Ag, then S-65 was added in an amount of $2.0\times10^{-3}$ mol/mol-Ag in place of using sensitizing dye-1 was named Sample No. 902.

For examining the sensitivity of the thus-obtained samples, samples were exposed for 1/100 second through an optical wedge and a green filter using Fuji FW type sensitometer (a product of Fuji Photo Film Co., Ltd.), subjected to Fuji Photo Film CN16 processing and photographic characteristics were compared. Sensitivity was a reciprocal of exposure amount required to give a density of fog+0.2 and expressed as a relative value taking the sensitivity of Sample No. 901 as a control.

TABLE 15

| Sample No. | Sensitivity (foq + 0.2) |
|---|---|
| 901 | 100 (control) |
| 902 | 301 |

It was found that the sensitivity of a silver chloride tabular emulsion having {111} face as outer face was also improved due to the increase of the dye adsorption amount by the addition method of a dye according to the present invention.

EXAMPLE 10

Octahedral silver chloride grain emulsion was prepared in the same manner as the preparation of Emulsion F in Example 3 of Japanese Patent Application No. 7-146891, this was named Emulsion 10A.

Coated samples were prepared in the same manner as the preparation of Coated Sample No. F in Example 3 of Japanese Patent Application No. 7-146891. A sample in which Emulsion F in Coated Sample No. F in Example 3 of Japanese Patent Application No. 7-146891 was replaced with Emulsion 10A, and sensitizing dye-1 was replaced with a mixture of H-16 in an amount of $3.0\times10^{-3}$ mol/mol-Ag and H-17 in an amount of $2.0\times10^{-3}$ mol/mol-Ag was named Sample No. 1001, and a mixture of S-9 in an amount of $3.0\times10^{-3}$ mol/mol-Ag and S-45 in an amount of $2.0\times10^{-3}$ mol/mol-Ag was named Sample No. 1002.

For examining the sensitivity of the thus-obtained samples, samples were exposed for 1/100 second through an optical wedge and a blue filter using Fuji FW type sensitometer (a product of Fuji Photo Film Co., Ltd.), subjected to Fuji Photo Film CN16 processing and photographic characteristics were compared. Sensitivity was a reciprocal of exposure amount required to give a density of fog+0.2 and expressed as a relative value taking the sensitivity of Sample No. 1001 as a control.

TABLE 16

| Sample No. | Sensitivity (fog + 0.2) |
|---|---|
| 1001 | 100 (control) |
| 1002 | 332 |

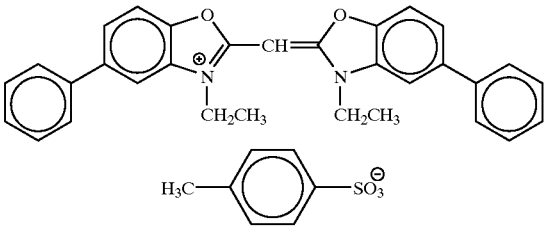

-continued

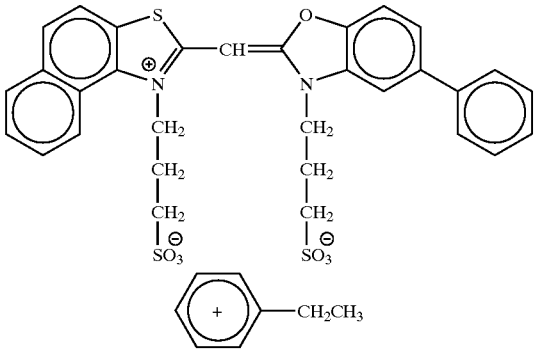

It was found that the sensitivity of an octahedral silver chloride emulsion was also improved due to the increase of the dye adsorption amount by the addition method of a dye according to the present invention.

EXAMPLE 11

Tabular grain emulsions were prepared in the same manner as the preparation of Emulsion CC disclosed in European Patent 0699950, and in chemical sensitization H-18 was added in an amount of $2.0\times10^{-3}$ mol/mol-Ag and chemical sensitization was conducted, then H-18 was added in an amount of $4.0\times10^{-3}$ mol/mol-Ag, thereafter, further, H-19 was added in an amount of $5.5\times10^{-3}$ mol/mol-Ag, this emulsion was named Emulsion 11A, or S-13 was added in an amount of $2.0\times10^{-3}$ mol/mol-Ag, after chemical sensitization, S-13 was added in an amount of $4.0\times10^{-3}$ mol/mol-Ag and, still further, S-47 was added in an amount of $5.5\times10^{-3}$ mol/mol-Ag, this emulsion was named Emulsion 11B, or S-13 was added in an amount of $2.0\times10^{-3}$ mol/mol-Ag, after chemical sensitization was conducted, S-13 was added in an amount of $1.5\times10^{-3}$ mol/mol-Ag and, still thereafter, S-47 was added in an amount of $1.5\times10^{-3}$ mol/mol-Ag, this emulsion was designated Emulsion 11C, or S-13 was added in an amount of $2.0\times10^{-3}$ mol/mol-Ag, after chemical sensitization was conducted, S-13 was added in an amount of $1.0\times10^{-3}$ mol/mol-Ag and, still thereafter, S-47 was added in an amount of $1.0\times10^{-3}$ mol/mol-Ag, this emulsion was designated Emulsion 11D.

The light absorption strength of the obtained emulsions was searched for in the same manner as in Example 1.

Coated samples were prepared in the same manner as the preparation of the coated samples in the example of European Patent 0699950, and a sample in which Emulsion 11A was used was named Sample No. 1101, 11B was named Sample No. 1102, 11C was named Sample No. 1103, and 11D was used was named Sample No. 1104. Exposure and development were conducted in the same manner as in European Patent 0699950 and photographic characteristics were prepared. Sensitivity was a reciprocal of exposure amount required to give a density of fog+0.2 and expressed as a relative value taking the sensitivity of Sample No. 1101 as a control.

TABLE 17

| Sample No. | Sensitivity (fog + 0.2) | Light Absorption Strength |
|---|---|---|
| 1101 (control) | 100 | 49 |

TABLE 17-continued

| Sample No. | Sensitivity (fog + 0.2) | Light Absorption Strength |
|---|---|---|
| 1102 | 403 | 189 |
| 1103 | 170 | 87 |
| 1104 | 123 | 62 |

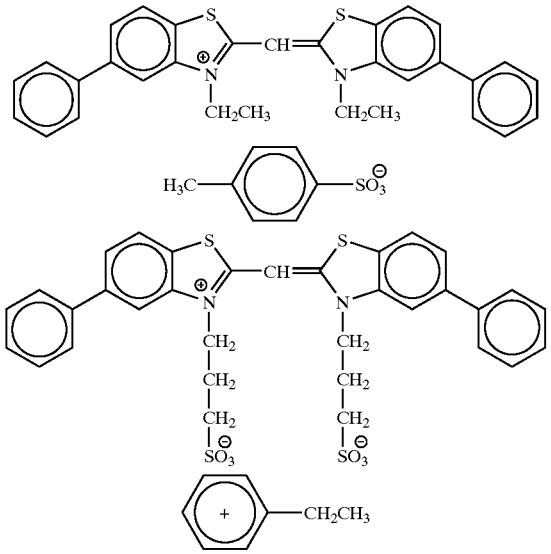

Effect of the Invention

According to the present invention, an emulsion having high light absorption factor per unit area of a grain surface and a photographic material of high sensitivity using said emulsion.

While the invention has been described in detail and with reference to specific examples thereof, it will be apparent to one skilled in the art that various changes and modifications can be made therein without departing from the spirit and scope thereof.

What is claimed is:

1. A silver halide color photographic material containing a cyan coupler, a magenta coupler and a yellow coupler, and comprising a silver halide photographic emulsion comprising silver halide grains that have been spectrally sensitized with sensitizing dyes that are multilayer adsorbed onto a surface of said silver halide grains, wherein said sensitizing dyes comprise an anionic dye and a cationic dye;

said sensitizing dyes are selected from the group consisting of a cyanine dye, a merocyanine dye, a complex cyanine dye, a holopolar cyanine dye, a hemicyanine dye, a styryl dye and a hemioxonol dye; and said silver halide grains are tabular grains having an aspect ratio of 10 or more and have a halogen composition of the outermost surface such that iodide content is 0.1 mol % or more.

2. The silver halide color photographic material according to claim 1, wherein the total addition amount of said sensitizing dyes is 160% or more of the saturated coated amount of said silver halide grains.

3. The silver halide color photographic material according to claim 1, wherein 30% or more of the total addition amount of said sensitizing dyes is the anionic dye, and 30% or more of the total addition amount of said sensitizing dyes is the cationic dye.

4. The silver halide color photographic material according to claim 1, wherein at least one of said sensitizing dyes comprises a merocyanine or complex merocyanine dye having a nucleus having a ketomethylene structure.

5. A method for producing a silver halide color photographic material containing a cyan coupler, a magenta coupler and a yellow coupler, and comprising a silver halide photographic emulsion comprising silver halide grains that have been spectrally sensitized with sensitizing dyes that are multilayer adsorbed onto a surface of said silver halide grains, wherein said sensitizing dyes comprise an anionic dye and a cationic dye;

said silver halide grains are tabular grains having an aspect ratio of 10 or more and have a halogen composition of the outermost surface such that iodide content is 0.1 mol % or more, wherein said silver halide photographic emulsion is prepared by adding the anionic dye and the cationic dye differently; and at least one of the anionic dye and the cationic dye is a) directly dispersed in a hydrophilic colloid to form a dispersion and the dispersion is added to a silver halide emulsion, or b) dissolved by a compound capable of red-shifting an absorption of said dye to form a solution and the solution is added to a silver halide emulsion.

6. The method for producing a silver halide color photographic material according to claim 5, wherein 30% or more of the total addition amount of said sensitizing dyes is the anionic dye, and 30% or more of the total addition amount of said sensitizing dyes is the cationic dye.

7. The method for producing a silver halide color photographic material according to claim 5, wherein the total addition amount of said sensitizing dyes is 160% or more of the saturated coated amount of said silver halide grains.

* * * * *